US011374358B2

(12) United States Patent
Kajiura et al.

(10) Patent No.: US 11,374,358 B2
(45) Date of Patent: Jun. 28, 2022

(54) WIRE TO BOARD CONNECTOR WITH LOW HEIGHT

(71) Applicant: Amphenol FCI Asia Pte. Ltd., Singapore (SG)

(72) Inventors: Motomu Kajiura, Tokyo (JP); Yasutoshi Kameda, Kisarazu (JP)

(73) Assignee: Amphenol FCI Asia Pte. Ltd., Singapore (SG)

( * ) Notice: Subject to any disclaimer, the term of this patent is extended or adjusted under 35 U.S.C. 154(b) by 0 days.

(21) Appl. No.: 16/918,061

(22) Filed: Jul. 1, 2020

(65) Prior Publication Data

US 2021/0006012 A1 Jan. 7, 2021

Related U.S. Application Data

(60) Provisional application No. 62/869,511, filed on Jul. 1, 2019.

(51) Int. Cl.
*H01R 13/627* (2006.01)
*H01R 13/193* (2006.01)
*H01R 13/04* (2006.01)

(52) U.S. Cl.
CPC ..... *H01R 13/6273* (2013.01); *H01R 13/04* (2013.01); *H01R 13/193* (2013.01)

(58) Field of Classification Search
CPC ..... H01R 23/682; H01R 13/6273; H01R 13/193; H01R 13/04
(Continued)

(56) References Cited

U.S. PATENT DOCUMENTS 6,796,825 B2 * 9/2004 Wang ..... H01R 13/6315 439/326
6,908,345 B2 6/2005 Shimizu et al.
(Continued)

FOREIGN PATENT DOCUMENTS

CN 101238613 A 8/2008
CN 104348030 A 2/2015
(Continued)

OTHER PUBLICATIONS

PCT/IB2020/000567, Oct. 6, 2020, International Search Report and Written Opinion.
(Continued)

*Primary Examiner* — Gary F Paumen
(74) *Attorney, Agent, or Firm* — Wolf, Greenfield & Sacks, P.C.

(57) ABSTRACT

A low profile wire to board connector with features that enable a height of 1 mm or less, yet sufficient robustness to preclude unintentional separation of mated connectors. A board connector, with a mounting interface configured for surface mount soldering to a PCB, may include a recess for receiving a complementary connector terminating multiple wires. The board connector may have blade-shaped terminals, which may be soldered to the PCB at two ends, with an intermediate portion engaging a portion of the board connector housing, so as to secure the housing to the PCB. The complementary connector may be inserted at an acute angle with the mounting interface, engaging a front portion of the mating connector to a front portion of the board connector. The rear of the complementary connector may then be rotated into the recess and secured near the rear.

28 Claims, 15 Drawing Sheets

(58) Field of Classification Search
USPC ..... 439/326, 341
See application file for complete search history.

(56) References Cited

U.S. PATENT DOCUMENTS

| | | | | |
|---|---|---|---|---|
| 7,070,465 | B2 | 7/2006 | Masaki et al. | |
| 7,112,102 | B2 | 9/2006 | Masaki et al. | |
| 7,118,424 | B2 | 10/2006 | Masaki et al. | |
| 7,156,678 | B2 | 1/2007 | Feldman et al. | |
| 7,303,444 | B2 | 12/2007 | Denpouya | |
| 7,445,482 | B2 * | 11/2008 | Ho | H01R 12/83 439/326 |
| 7,632,158 | B2 | 12/2009 | Denpouya et al. | |
| 7,828,585 | B2 | 11/2010 | Kurimoto | |
| 7,950,968 | B2 | 5/2011 | Qian | |
| 8,011,944 | B2 | 9/2011 | Umehara et al. | |
| 8,043,114 | B2 * | 10/2011 | Kaneko | H01R 12/716 439/497 |
| 8,398,422 | B2 * | 3/2013 | Zhu | H01R 13/41 439/326 |
| 8,454,380 | B2 * | 6/2013 | Zhu | H01R 12/7029 439/326 |
| 9,048,569 | B2 | 6/2015 | Chen | |
| 9,153,904 | B2 | 10/2015 | Chen et al. | |
| 9,236,671 | B2 | 1/2016 | Chen et al. | |
| 9,240,653 | B2 | 1/2016 | Urano et al. | |
| 9,246,260 | B2 | 1/2016 | Naganawa et al. | |
| 9,287,643 | B2 | 3/2016 | Yoshida | |
| 9,306,325 | B2 * | 4/2016 | Cheng | H01R 12/88 |
| 9,450,319 | B2 | 9/2016 | Nishimura | |
| 9,570,817 | B1 | 2/2017 | Wang et al. | |
| 9,647,401 | B2 | 5/2017 | Sato | |
| 9,748,677 | B2 * | 8/2017 | Urano | H01R 12/91 |
| 9,941,630 | B2 | 4/2018 | Sato | |
| 9,991,631 | B2 | 6/2018 | Zhao et al. | |
| 2005/0136724 | A1 * | 6/2005 | Lin | G06F 1/185 439/326 |
| 2011/0151708 | A1 | 6/2011 | Kaneko et al. | |
| 2015/0044913 | A1 | 2/2015 | Chen | |
| 2015/0207244 | A1 | 7/2015 | Urano et al. | |
| 2015/0270642 | A1 | 9/2015 | Cheng | |

FOREIGN PATENT DOCUMENTS

| | | | |
|---|---|---|---|
| CN | 104364975 | A | 2/2015 |
| EP | 2876743 | A1 | 5/2015 |
| JP | 2006-344524 | A | 12/2006 |
| JP | 4115983 | B2 | 7/2008 |
| JP | 2008-192422 | A | 8/2008 |
| JP | 2013-026159 | A | 2/2013 |
| JP | 5385022 | B2 | 1/2014 |
| JP | 2014-038822 | A | 2/2014 |
| JP | 6483038 | B2 | 3/2019 |
| JP | 6534829 | B2 | 6/2019 |
| KR | 10-2015-0009993 | A | 1/2015 |

OTHER PUBLICATIONS

International Search Report and Written Opinion in connection with International Application No. PCT/IB2020/000567, dated Oct. 6, 2020.

* cited by examiner

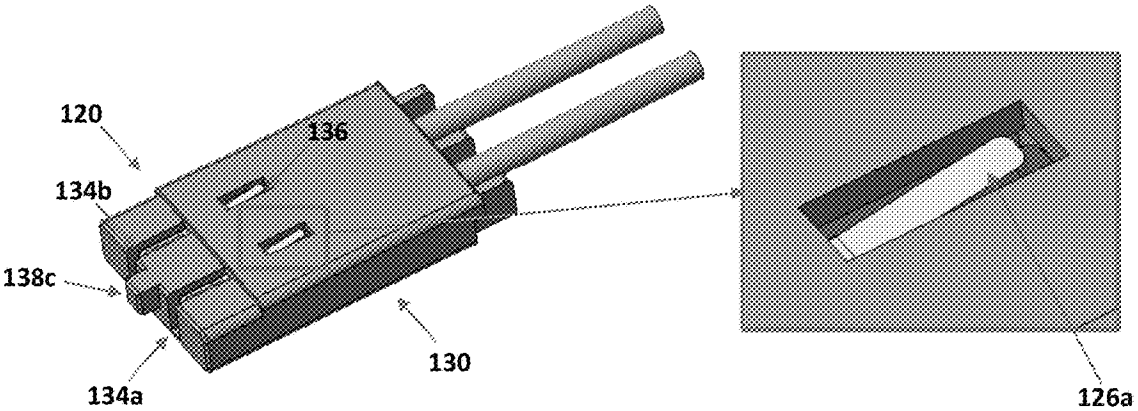
FIG. 3A
FIG. 3B
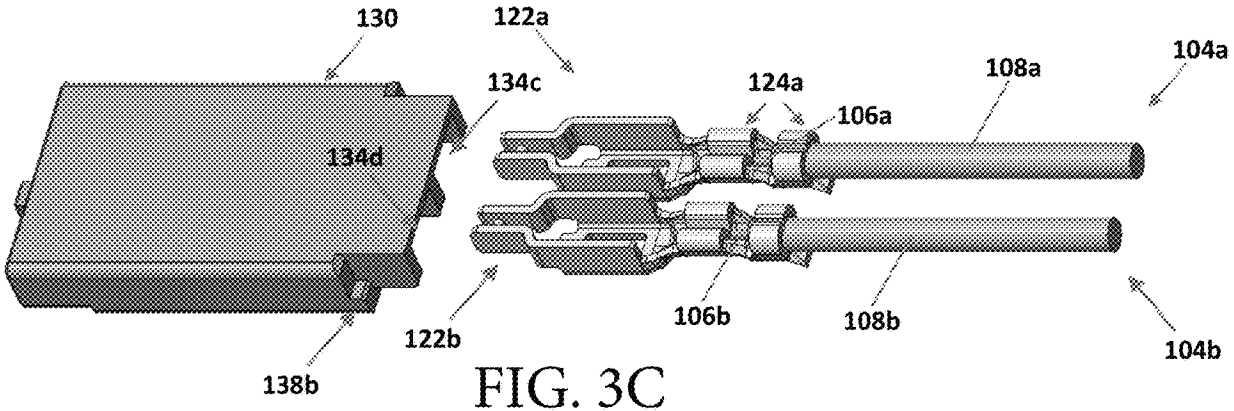
FIG. 3C
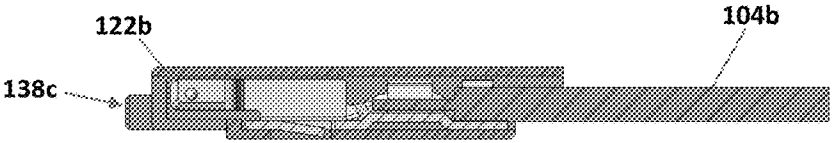
FIG. 3D

WIRE TO BOARD CONNECTOR WITH LOW HEIGHT

CROSS-REFERENCE TO RELATED APPLICATIONS

This application claims priority to and the benefit under 35 U.S.C. § 119(e) of U.S. Provisional Patent Application Ser. No. 62/869,511, filed on Jul. 1, 2019, entitled "WIRE TO BOARD CONNECTOR WITH LOW HEIGHT," which is hereby incorporated herein by reference in its entirety.

BACKGROUND

Wire to board electrical connectors allow the transfer of power and/or data signals between a printed circuit board (PCB) and other components of an electronic system. In one example, power may be provided to devices mounted on the circuit board by a wire to board connector that connects a power wire to a conductive power trace on a surface of the PCB. In another example, data may be provided to devices mounted on the circuit board by a wire to board connector that connects a data wire to a conductive data trace on a surface of the PCB.

BRIEF SUMMARY

Embodiments of a low profile wire to board connector are described. In accordance with some embodiments, an electrical connector may comprise an insulative housing comprising an opening for receiving a second connector, the opening being bounded by at least a first wall and a second wall of the insulative housing, and the first wall comprising at least one receiving portion configured to receive a projection from the second connector, and the second wall being transverse to the first wall, a plurality of conductive terminals attached to the first wall of the insulative housing and extending into the opening, and at least one locking tab attached to the second wall of the insulative housing. The at least one locking tab may comprise a compliant portion configured to engage a surface on the second connector when the second connector is inserted in the opening.

In accordance with some embodiments, an electrical connector may comprise an insulative housing, a plurality of conductive terminals supported by the insulative housing, and at least one spring supported by the insulative housing. The insulative housing may comprise an opening for receiving a second connector. The first connector may comprise a first retention feature for engaging the second connector at a first end of the opening and a second retention feature for engaging the second connector at a second end of the opening, with the first end offset from the second end in a first direction. The at least one spring may be configured to apply a force to the second connector in the first direction when the second connector is in the opening.

In accordance with some embodiments, a method of mating a cable connector with a board connector may comprise inserting the cable connector into a recess of the board connector along a first direction, securing the cable connector to the board connector at least in part by:

applying a spring force to the cable connector in a second direction at least partially opposite the first direction, and impeding movement of the cable connector in direction perpendicular to the second direction.

BRIEF DESCRIPTION OF THE DRAWINGS

FIG. 3A is a bottom perspective view of the receptacle connector 120 of FIGS. 1A-1B, in accordance with some embodiments;

FIG. 3B is a zoomed view of the receptacle connector 120 of FIGS. 1A-1B, in accordance with some embodiments;

FIG. 3C is an exploded view of the receptacle connector 120 of FIGS. 1A-1B, illustrating the receptacle housing 130 separate from the receptacle terminals 122*a* and 122*b* and wires 104*a* and 104*b*, in accordance with some embodiments;

FIG. 3D is a side view of a cross-section of the receptacle connector 120 of FIGS. 1A-1B through the insulated wire 104*b* and the receptacle terminal 122*b*, in accordance with some embodiments;

DETAILED DESCRIPTION

Figure 1A:
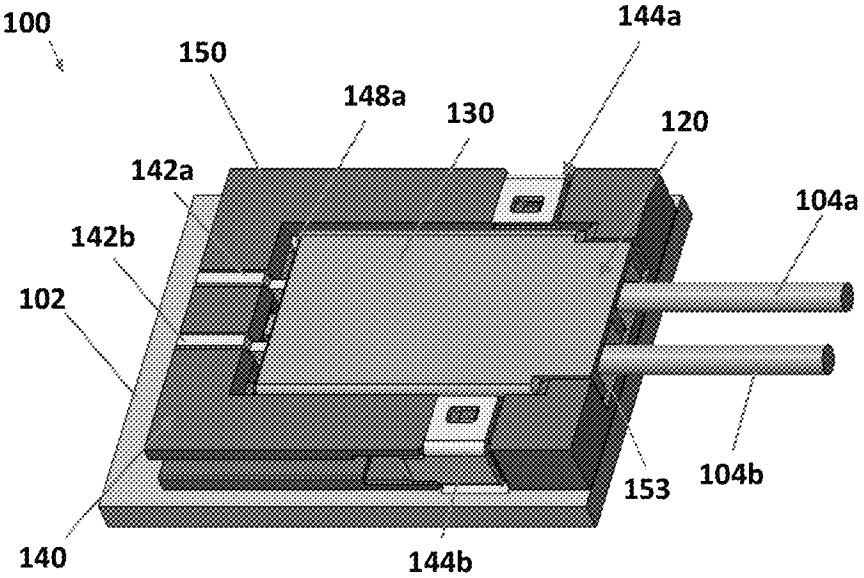
FIG. 1A is a top perspective view of an electrical interconnect system 100 that includes a receptacle connector 120 and a plug connector 140, in accordance with some embodiments.

The inventors have recognized and appreciated design techniques for electrical connectors that enable wire to board (or cable to board) receptacle and plug connectors to occupy a small volume while providing reliable operation. Such connectors may have a height of 1 mm or less. Techniques as described herein may lead to compact connectors that resist unintentional unmating.

The inventors have recognized that small receptacle and plug connectors may be unintentionally unmated if pressure is applied to wires or cables that terminate at the receptacle connector. For example, if the wires or cables are pulled away from the plug connector, the receptacle may be removed from the plug connector. Wires may be pulled, for example, when the wires extend outside an electronic device. Wires attached to earbuds, for example, may extend out of a portable electronic device and may be unintentionally pulled in use.

In accordance with some embodiments, receptacle and plug connectors may be reliably secured to one another in a manner which reduces the risk of unintentionally unmating the receptacle connector from the plug connector. In some embodiments, a receptacle connector may be inserted into a recess of a plug connector along an insertion direction and a member within the plug connector may apply a spring force to the receptacle connector in a securing direction to secure the receptacle connector to the plug connector.

The forward edge of the receptacle connector, for example, may be inserted into the recess of the plug connector. In the illustrated embodiments, the forward edge of the receptacle connector mates with blade contacts of the plug connector. The rear edge of the receptacle connector may be shaped to interlock with a portion of the plug housing along a side opposite the blades of the plug. In this example, the securing direction is from the blades towards the opposite side of the plug connector. As a result, when the receptacle moves in the securing direction, features on the rear edge of the receptacle interlock with complementary features on the plug housing, preventing the receptacle from being lifted out of the recess in the plug.

The spring force may be applied at least partially opposite the insertion direction and partially along a bottom surface of the recess, so as to secure the receptacle connector to the plug connector.

In some embodiments, a forward edge of a receptacle connector may be inserted into a recess of a plug connector along an insertion direction that is angled with respect to a mounting face of the plug connector. The receptacle may engage the plug connector at the forward edge of the receptacle connector. The forward edge of the receptacle connector may be inserted into the recess of the plug connector and mate with blade contacts of the plug connector. The front edge of the receptacle connector may be shaped to interlock with a portion of the plug housing along a portion having the blade contacts of the plug connector, thus impeding inadvertent upward removal of the receptacle connector from the plug connector.

Rear portions of the plug and/or receptacle connectors may further include features that impede inadvertent rearward removal of the receptacle connector. Securing the receptacle connector in the plug may entail rotating the receptacle connector about the engaged front edge such that the rear of the receptacle rotates towards the mounting face of the plug connector. Features at the rear of the receptacle and/or plug connectors may then engage so as to hold the receptacle connector in the plug connector.

In some embodiments, the features may include a member within the plug connector that engages the receptacle connector to secure the receptacle connector to the plug connector. The member may be a locking tab coupled to a side wall of the plug housing. A locking tab may have portions, which may be formed from a folded piece of metal, disposed over opposite sides of the side wall. At least one of the portions of the locking tab may be soldered to the board. This soldering may form at least a portion of the attachment of the plug connector to the board. Accordingly, the locking tab may be reliably secured to the board to provide adequate contact force for holding the receptacle connector in the plug connector and the plug connector to the board in the event the receptacle connector is inadvertently pulled upwards.

In some embodiments, the rear edge of the receptacle connector may include projections that engage with features at the rear of the plug connector when the receptacle connector slides rearward. As a result, a rearward sliding motion may secure the receptacle connector in the plug connector. A rearward sliding motion may be imparted by a spring member between the plug and the receptacle that is compressed upon insertion of the receptacle into the plug connector.

Figure 1B:
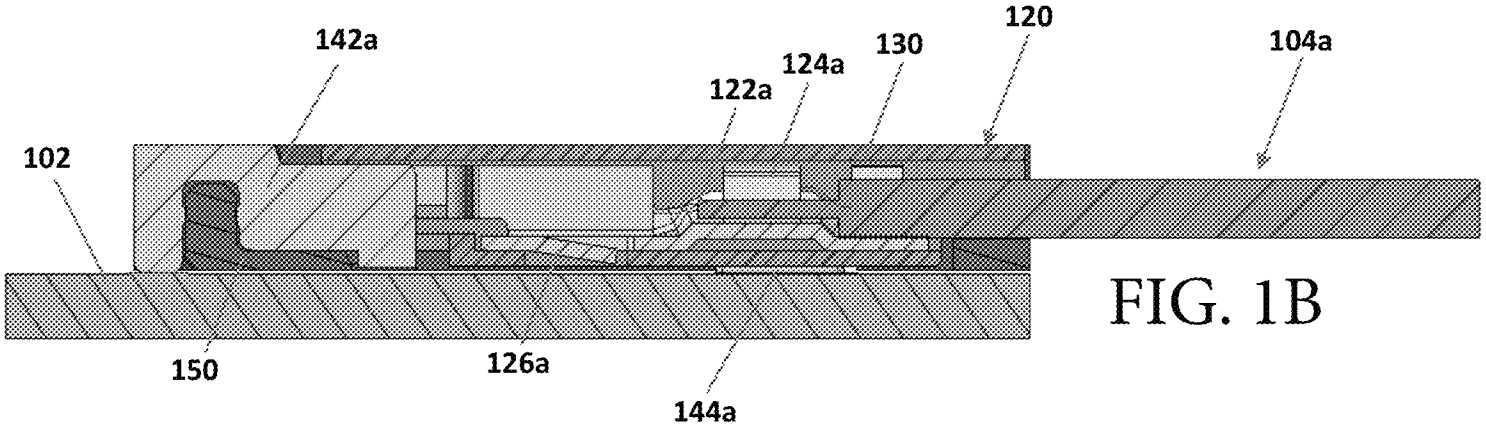
FIG. 1B is a cross-sectional side view of the electrical interconnect system 100 of FIG. 1A, in accordance with some embodiments.

Turning to the figures, FIG. 1A is a top perspective view of an electrical interconnect system 100 including a receptacle connector 120 and a plug connector 140, in accordance with some embodiments. FIG. 1B is a cross-sectional side view of the receptacle connector 120 and the plug connector 140.

For simplicity of description, mating connectors are identified as plug and receptacle based on the shape of their terminals. In this example, the receptacle connector has terminals with members that deflect to generate a contact force upon mating. Here, the deflecting members are opposing members that mate with a blade from the plug connector inserted between them. However, the description herein of mating and securing connectors to one another applies regardless of the shape of the terminals of those connectors. For example, plug connector 140 is shown mounted to a printed circuit board and receptacle connector 120 is shown terminating multiple wires. In other embodiments, a connector mounted to a board may have terminals shaped for a receptacle and a connector terminating a cable may have terminals shaped as blades. Alternatively, each connector may have some plug terminals and some receptacle terminals. Further, it is not a requirement that the plug terminals are rigid during mating. In some embodiments, both the plug and the receptacle terminals may deflect upon mating.

As shown in FIGS. 1A-1B, the plug connector 140 may be mounted to a board 102, which may be a printed circuit board in some embodiments. In this example, mounting is achieved by placing a mounting face of plug connector 140 on the board 102 and surface mount soldering the connector to the board. The receptacle connector 120 may terminate two insulated wires 104*a* and 104*b*. In the mated configuration shown in FIG. 1A, receptacle connector 120 and plug connector 140 may electrically connect conductors within insulated wires 104*a* and 104*b* with conductive pads (not shown) on the board 102. In some embodiments, the electrical interconnect system 100 may have a small form factor, such as less than 1 mm in height. Height may be measured relative to a surface of a substrate to which one of the connectors is mounted.

The receptacle connector 120 includes a receptacle housing 130, which may support receptacle terminals 122*a* and 122*b*, of which terminal 122*a* is shown in FIG. 1B. The receptacle housing 130 may be formed using an insulative material such as plastic. The receptacle terminals 122*a* and 122*b* may be formed using a conductive material such as phosphor bronze. In FIG. 1B, the receptacle terminal 122*a* may be attached to a conductor of the insulated wire 104*a*, with crimped portion 124*a* of receptacle terminal 122*a* holding the conductor. The conductor may be copper or other metal, in some embodiments, with or without plating, such as silver plating. Designs as described herein may be used in connection with small diameter wires. The conductors may have a diameter less than 32 AWG, in some embodiments. In other embodiments, the diameter may be smaller than 34 AWG, such as 36 AWG or 40 AWG, or smaller.

A terminal lance 126*a* of the receptacle terminal 122*a* may protrude into and, in the illustrated embodiment through, an opening in the receptacle housing 130 to prevent the receptacle terminal 122*a* from being removed from the receptacle housing 130 when the insulated wire 104*a* is pulled away from the receptacle housing 130. The terminal lance 126*a* may be shaped to slide along the bottom wall of the receptacle housing 130 when inserted into the receptacle housing 130. The receptacle terminal 122*a* is further illustrated in FIGS. 3C-3D and 4A-4B. In some embodiments, the receptacle connector 120 may have a height of 1 mm or less such that when the receptacle connector 120 is inserted into plug connector 140 the height of the mated connectors may be 1 mm or less.

The plug connector 140 may include a plug housing 150, which may support plug terminals 142*a* and 142*b* and spring tabs 144*a* and 144*b*. The plug housing 150 may be formed using an insulative material such as plastic. The plug terminals 142*a* and 142*b* and the spring tabs 144*a* and 144*b* may be formed using a conductive material such as phosphor bronze, with or without plating to support surface mount soldering of the plug terminals to board 102. The plug terminals 142*a* and 142*b* may have blade contacts. As shown in FIG. 1B, the plug terminal 142*a* has a first portion 162*a* configured for surface mount soldering to a pad on the surface of the board 102 and a second portion 162*b* positioned to contact the receptacle terminal 122*a* when the receptacle connector 120 is inserted into the plug connector 140. The bottom surface of the plug housing 150 may have openings to allow the plug terminals 142*a* and 142*b* and the spring tabs 144*a* and 144*b* to be mounted (e.g., soldered) to conductive pads on the board 102, thereby securing the plug terminals 142*a* and 142*b* and the spring tabs 144*a* and 144*b* to the board 102.

In some embodiments, in addition to electrically coupling the plug terminals 142*a* and 142*b* to the board 102, securing the plug terminals 142*a* and 142*b* and the spring tabs 144*a* and 144*b* to the board 102 may mechanically secure the plug housing 150 to the board 102. In the embodiment illustrated, each of the plug terminals 142*a* and 142*b* has a portion outside housing 150 configured for soldering to board 102 and a portion in an interior of plug housing 150 also for soldering. Between the two portions, the plug terminals engage a wall of housing 150, securing the housing to the board when the ends of the terminal are soldered to the board.

As shown in FIG. 1B, the plug terminal 142*a* may electrically couple to the receptacle terminal 122*a* to a conductive pad on the surface of the board 102 such that a conductor of the insulated wire 104*a*, which is connected to receptacle terminal 122*a* is electrically connected to board 102. In some embodiments, the plug connector 140 may have a height of 1 mm or less.

In some embodiments, insulated wires 104*a* and 104*b* may have at least one electrical conductor 106 which may be surrounded by an insulator 108 (shown in FIGS. 3C-3D and 4A-4B). For example, the electrical conductor(s) 106 may include a pair of copper wires wrapped in plastic 108. In some embodiments, the wires may be AWG 36 or 40 wires. It should be appreciated that electrical interconnect systems described herein may be configured to support any number of wires.

Figure 2A:
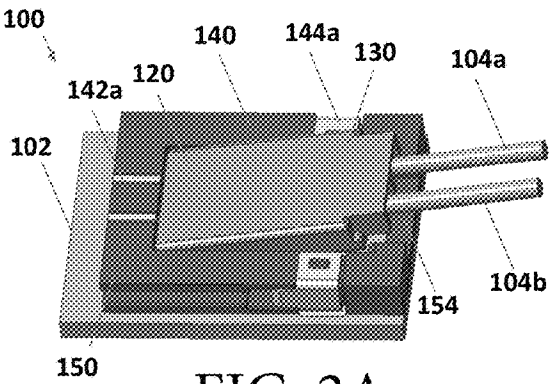
FIG. 2A is a perspective view of the electrical interconnect system 100 of FIGS. 1A-1B in which the receptacle connector 120 is partially inserted into the plug connector 140, in accordance with some embodiments.
Figure 2B:
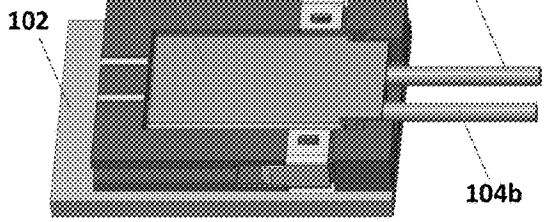
FIG. 2B is a perspective view of the electrical interconnect system 100 of FIGS. 1A-1B, with receptacle connector 120 in an inserted, unsecured position with respect to plug connector 140, in accordance with some embodiments.
Figure 2C:
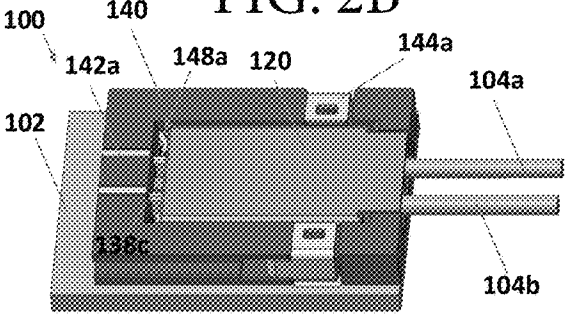
FIG. 2C is a perspective view of the electrical interconnect system 100 of FIGS. 1A-1B with receptacle connector 120 in a secured position with respect to plug connector 140, in accordance with some embodiments.
Figure 2D:
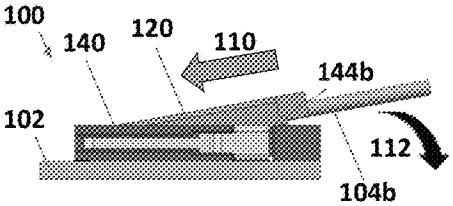
FIG. 2D is a side view of the electrical interconnect system 100 of FIGS. 1A-1B, in which the receptacle connector 120 is partially inserted into the plug connector 140 as illustrated in FIG. 2A, in accordance with some embodiments.
Figure 2E:
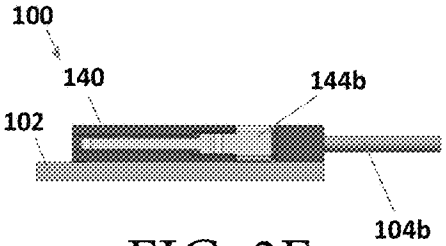
FIG. 2E is a side view of the electrical interconnect system 100 of FIGS. 1A-1B with receptacle connector 120 in the inserted, unsecured position illustrated in FIG. 2B, in accordance with some embodiments.
Figure 2F:
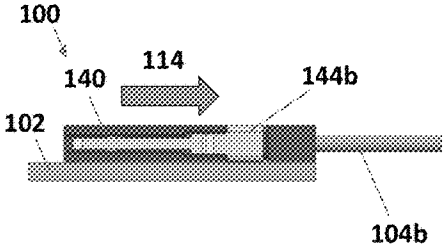
FIG. 2F is a side view of the electrical interconnect system 100 of FIGS. 1A-1B with receptacle connector 120 in the secured position illustrated in FIG. 2C, in accordance with some embodiments.
Figure 2G:
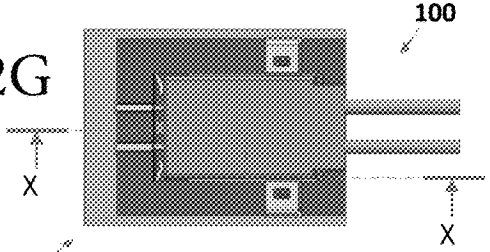
FIG. 2G is a top view of the electrical interconnect system 100 of FIGS. 1A-1B with receptacle connector 120 in the secured position illustrated in FIG. 2C.
Figure 2H:
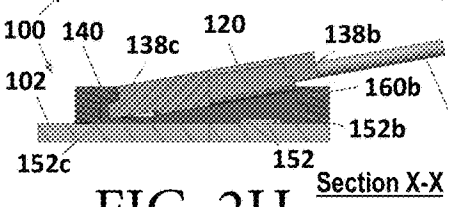
FIG. 2H is a side view of a cross-section of the electrical interconnect system 100 of FIGS. 1A-1B in which the receptacle connector 120 is partially inserted into the plug connector 140 as illustrated in FIG. 2A, in accordance with some embodiments.
Figure 2I:
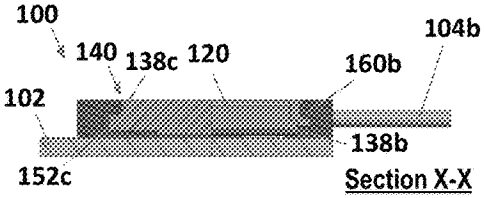
FIG. 2I is a side view of a cross-section of the electrical interconnect system 100 of FIGS. 1A-1B with receptacle connector 120 in the secured position illustrated in FIG. 2C in the inserted, unsecured position illustrated in FIG. 2B, in accordance with some embodiments.
Figure 2J:
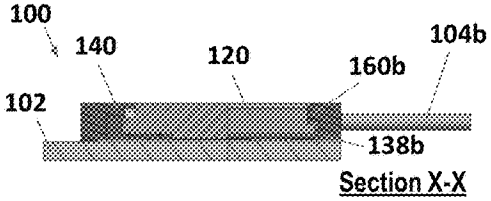
FIG. 2J is a side view of a cross-section of the electrical interconnect system 100 of FIGS. 1A-1B with receptacle connector 120 in the secured position illustrated in FIG. 2C in the secured position illustrated in FIG. 2C, in accordance with some embodiments.

FIGS. 2A-2J illustrate a method of mating the receptacle connector 120 with the plug connector 140 of the electrical interconnect system 100. FIGS. 2A-2C are top perspective views of the electrical interconnect system 100 as the receptacle connector 120 is inserted into and secured to the plug connector 140. FIGS. 2D-2F are side views of the electrical interconnect system 100 as the receptacle connector 120 is inserted into and secured to the plug connector 140. FIGS. 2H-2J are side views of a cross section of the electrical interconnect system 100 as the receptacle connector 120 is inserted into and secured to the plug connector 140. FIG. 2G is a top view of the electrical interconnect system 100, with the receptacle connector 120 secured in the plug connector 140, indicating the cross-section X-X shown in FIGS. 2H-2J.

As shown in FIGS. 2A, 2D, and 2H, the receptacle connector 120 may be inserted along an insertion direction 110 into the plug connector 140. The insertion direction 110 may make an acute angle with respect to the board 102, such as results from a forward end of receptacle connector 120 being inserted into the plug connector 140 with the receptacle connector 120 oriented with a greater distance between the insulated wires 104*a* and 104*b* and the board 102 than between the forward end of the receptacle connector 120 and the board 102. Insertion at an angle enables a projection from the receptacle connector 120 to extend under a feature of the plug housing 150, partially securing the receptacle connector 120 in the plug connector 140.

As shown in FIGS. 2A and 2D, the plug housing 150 includes a recess 152 that may be shaped to accommodate the receptacle housing 130. The recess 152 includes receiving portions 152*a*-152*c*, which may be shaped to accommodate receptacle housing projecting portions 138*a*-138*c*, respectively. The receiving portions 152*a* and 152*b* and the projecting portions 138*a* and 138*b* may be disposed on opposite sides of the slot 154 at the rear ends of the plug connector 140 and the receptacle connector 120, respectively. The receiving portions 152*b*-152*c* and the projecting portions 138*b*-138*c* are shown in FIGS. 2H-2J. As shown in FIGS. 2H-2J, the receiving portion 152*c* and the projecting portion 138*c* are disposed on the front ends of the plug connector 140 and the receptacle connector 120, respectively. As the receptacle connector 120 is inserted into the recess 152 of the plug connector 140, the projecting portion 138*c* may enter the receiving portion 152*c*, as shown in FIG. 2H.

Once the receptacle connector 120 has been inserted into the recess 152, the receptacle connector 120 may be rotated in direction 112 toward the board 102. The axis of rotation for the receptacle connector 120 may be established by engagement of the front of the receptacle connector 120 with the front wall of the plug housing 150 and may be perpendicular to the insertion direction 110. FIGS. 2B, 2E, and 2I show the electrical interconnect system 100 in an inserted, unsecured state after the receptacle connector 120 has been rotated in the direction 112. As shown in FIG. 2I, for example, the projecting portion 138*c* is inserted into the receiving portion 152*c*, and the projecting portions 138*a* and 138*b* are not inserted into the receiving portions 152*a* and 152*b*.

Plug housing 150 may have a slot 154 in a rear wall of the plug housing 150 that accommodates the insulated wires 104*a* and 104*b* when the receptacle connector 120 is secured in the plug connector 140. The insulated wires 104*a* and 104*b* may be elongated in a direction that they extend through the slot 154.

As shown in FIGS. 2A-2C, while the receptacle connector 120 is inserted into the plug connector 140, at least one spring tab 144*a* of the plug connector 140 may apply a force to the receptacle connector 120. For example, a compliant portion 148*a* of the spring tab 144*a* may push (e.g., physically contact) the receptacle connector 120 in a securing direction 114 at least partially along the insertion direction 110, along a bottom surface of the recess 152 of the plug connector 140 to secure the receptacle connector 120 to the plug connector 140. The compliant portions 148*a* and 148*b* of the spring tabs 144*a* and 144*b* are shown in a depressed state in FIGS. 2A-2B, and in a relaxed state in FIG. 2C. The projecting portions 160*a* and 160*b* may be configured to secure the receptacle connector 120 when the spring tabs 144*a* and 144*b* push the receptacle connector along the bottom surface of the recess 152. The projecting portions 160*a* and 160*b* may be configured to impede movement in an upward direction away from the board 102. For example, the projecting portions 160*a* and 160*b* of the plug housing 150 may be positioned farther from the board 102 than the projecting portions 138*a* and 138*b* of the receptacle housing 130 when the receptacle connector 120 is secured to the plug connector 140. As shown in FIGS. 2H-2J, the projecting portion 152*b* is positioned above the receiving portion 152*b* in the upward direction away from the board 102. FIGS. 2C, 2F, and 2J show the electrical interconnect system 100 in an inserted, secured state. As shown in FIG. 2J, for example, the projecting portions 138*a* and 138*b* are inserted into the receiving portions 152*a* and 152*b*.

FIGS. 3A-3D further illustrate the receptacle connector 120 of FIGS. 1A-1B. FIG. 3A is a bottom perspective view of the receptacle connector 120. FIG. 3B is an enlarged view of a portion of the receptacle connector 120 illustrating engagement of a terminal 122*a* with the receptacle housing 130. As shown in FIGS. 3A-3B, the receptacle housing 130 includes slots 136, which may be shaped to secure the receptacle housing 130 to the terminal lances 126*a* and 126*b* of the receptacle terminals 122*a* and 122*b*. In FIGS. 3A-3B, the terminal lance 126*a* extends into a slot 136 on the bottom surface of the receptacle housing 130, blocking withdrawal of the terminal 122*a* from the receptacle housing 130. FIG. 3A further illustrates terminal slots 134*a* and 134*b*, which may be shaped to accommodate the plug terminals 142*a* and 142*b* when the receptacle connector 120 is inserted into the plug connector 140.

FIG. 3C is an exploded view of the receptacle connector 120 of FIGS. 1A-1B, illustrating the receptacle housing 130 separate from the receptacle terminals 122*a* and 122*b* and wires 104*a* and 104*b*. As shown in FIG. 3C, the receptacle terminals 122*a* and 122*b* may be inserted into terminal slots 134*c* and 134*d* of the receptacle housing 130 to form the receptacle connector 120. Also shown in FIG. 3C, the insulated wires 104*a* and 104*b* may include wire insulators 108*a* and 108*b* surrounding conductors 106*a* and 106*b*. FIG. 3D is a side view of a cross section of the receptacle connector 120 through the insulated wire 104*b* and the receptacle terminal 122*b*.

Figure 4A:
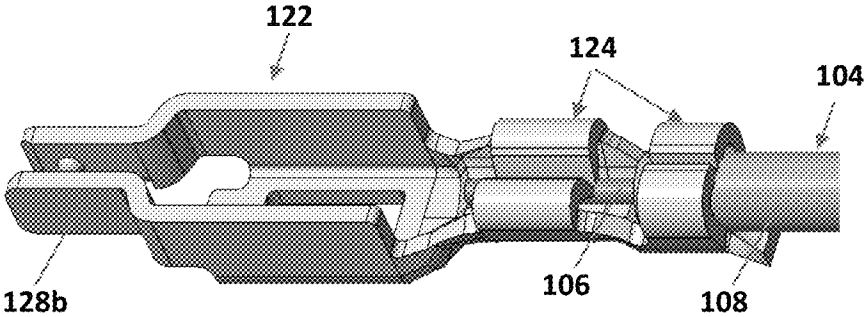
FIG. 4A is a top perspective view of a receptacle terminal 122 and an insulated wire 104 that may be included in the receptacle connector 120 of FIGS. 1A-1B, in accordance with some embodiments.
Figure 4B:
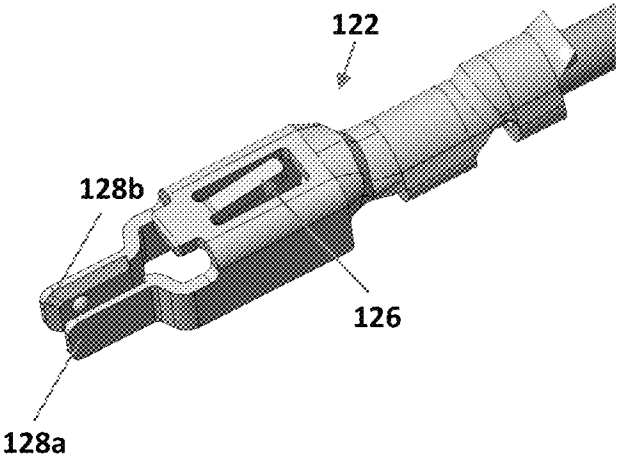
FIG. 4B is a bottom perspective view of the receptacle terminal 122 of FIG. 4A, in accordance with some embodiments.

FIGS. 4A-4B further illustrate the receptacle terminals 122*a* and 122*b* of the receptacle connector 120 and the insulated wires 104*a* and 104*b*. FIG. 4A is a top perspective view of a receptacle terminal 122, which may be either of the receptacle terminals 122*a* and 122*b* in the receptacle connector 120, and an insulated wire 104, which may be either of the insulated wires 104*a* and 104*b*, in accordance with some embodiments. FIG. 4B is a bottom perspective view of the receptacle terminal 122 and the insulated wire 104. As shown in FIG. 4A, crimped portions 124 of the receptacle terminal 122 are shown holding the conductor 106 and the wire insulator 108, respectively. The crimped portion around conductor 106*a* makes an electrical connection between the receptacle terminal 122*a* and the conductor 106*a*.

As shown in FIG. 4B, the receptacle terminal 122 includes first and second contact portions 128*a* and 128*b* shaped for contacting first and second sides of the receptacle contacts 142*a* and 142*b* of the plug connector 140, which may have blade contacts. The contact portions 128*a* and 128*b* may be compliant such that they exert a contact force on the plug contacts of the plug connector when the plug and the receptacle connectors are mated. Contact portions 128*a* and 128*b* may include protrusions to increase the contact pressure at the mating interface. In one example, displacing the contact portions 128*a* and 128*b* by 0.06 mm may exert a pressure of 800 MPa on the contact portions 128*a* and 128*b* and generate a contact force of 0.58 N. Also shown in FIG. 4B, a terminal lance 126 may be cut from the bottom side of the receptacle terminal 122. Terminal lance 126 may be biased away from the bottom side such that it will spring outwards and engage a feature of the receptacle housing 130 to secure the receptacle terminal 122 to the receptacle housing 130.

Figure 5B:
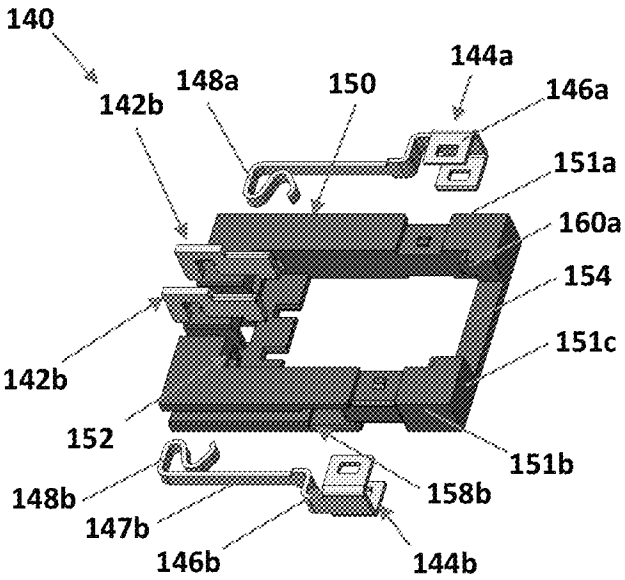
FIG. 5B is an exploded view of the plug connector 140 of FIGS. 1A-1B, in accordance with some embodiments.
Figure 5C:
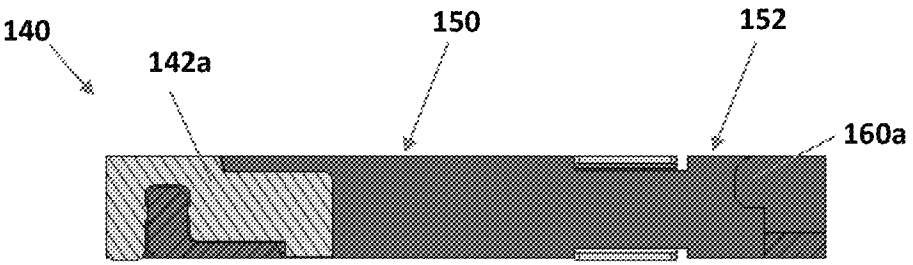
FIG. 5C is a side cross-sectional view of the plug connector 140 of FIGS. 1A-1B, in accordance with some embodiments.
Figure 5A:
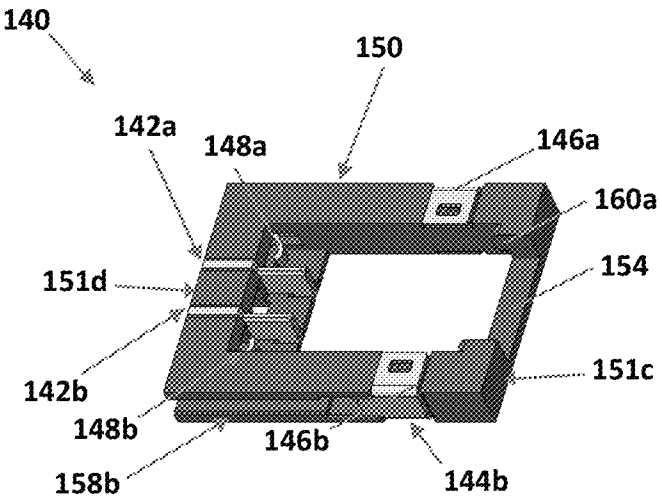
FIG. 5A is a top perspective view of the plug connector 140 of FIGS. 1A-1B, in accordance with some embodiments.

FIGS. 5A-5C further illustrate the plug connector 140 of FIGS. 1A-1B. FIG. 5A is a top perspective view of the plug when the plug connector and the receptacle connectors are mated. The contact portions 228*a* and 229*a* may include protrusions to increase the contact pressure at the mating interface connector 140. FIG. 5B is an exploded view of the plug connector 140. FIG. 5C is a side cross-sectional view of the plug connector 140 through plug terminal 142*a*.

Spring tabs 144*a* and 144*b* in FIGS. 5A-5C are an example of a spring member applying a spring force to the receptacle connector 120 upon mating to urge the receptacle connector 120 in the securing direction 114 (FIG. 2F). In accordance with various embodiments, one or more spring members may be used. As shown in FIG. 5B, two spring tabs 144*a* and 144*b* are attached to opposite sides of the plug housing 150. For example, in FIG. 5B, the spring tabs 144*a* and 144*b* are attached to sides 151*a* and 151*b* of the plug housing 150 that are perpendicular to the wall 151*d* through which the plug terminals 142*a* and 142*b* extend (e.g. front wall 151*d*).

The plug housing 150 may include openings 158*a* and 158*b* on the sides 151*a* and 151*b*, of which opening 158*b* is visible in FIGS. 5A-5B. Openings 158*a* and 158*b* may extend through the walls of plug housing such that the compliant portions 148*a* and 148*b* of the spring tabs 144*a* and 144*b* may extend into the opening of plug housing 150 that receives the receptacle connector. Accordingly, the compliant portions 148*a* and 148*b* may physically contact the receptacle connector 120 when the receptacle connector 120 is inserted into the plug connector 120. In the illustrated example, the compliant portions 148*a* and 148*b* of the spring tabs 144*a* and 144*b* are positioned alongside the plug terminals 142*a* and 142*b*, separated in the direction along which the plug terminals 142*a* and 142*b* are separated. In this position, the spring tabs 144*a* and 144*b* may be compressed when the forward end of the receptacle connector 120 is inserted into the plug housing 150 as shown in FIGS. 2A and 2B. Spring force within the spring tabs 144*a* and 144*b* may then urge the receptacle connector 120 in the securing direction, as illustrated in FIG. 2C. The openings 158*a* and 158*b* may accommodate compression of the compliant portions 148*a* and 148*b* by allowing corners of the bends in the compliant portions 148*a* and 148*b* to move within the openings in the direction in which the compliant portions 148*a* and 148*b* are compressed.

Spring tabs 144*a* and 144*b* may be held in the plug housing 150 with one or more features. The spring tabs 144*a* and 144*b* may be held adjacent the front wall 151*d* of the plug housing 150 such that they are captured between the receptacle connector 120 and plug housing 150 upon insertion of the receptacle connector 120. Alternatively or additionally, coupling portions 146*a* and 146*b* of the spring tabs 144*a* and 144*b* may be clipped onto sides of walls 151*a* and 151*b* of the plug housing 150. The elongated portions (e.g., 147*b* in FIG. 5B) that connect the compliant portions 148*a* and 148*b* to the coupling portions 146*a* and 146*b* may be disposed outside of the openings 158*a* and 158*b*.

Figure 6:
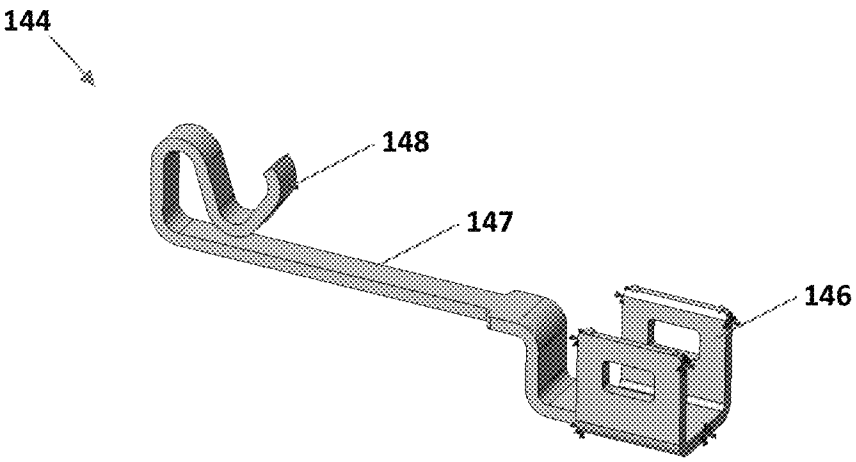
FIG. 6 is a top perspective view of a spring tab 144 that may be included in the plug connector 140 of FIGS. 1A-1B, in accordance with some embodiments.

FIG. 6 is a top perspective view of a spring tab 144 that may be either of the spring tabs 144*a* and 144*b* of the plug connector 140, in accordance with some embodiments. FIG. 6 shows the coupling portions 146 and compliant portion 148 of the spring tab 144, with an elongated portion 147 connecting the coupling portions 146 to the compliant portion 148. In some embodiments, the spring tab 144 can generate force that urges the receptacle connector into a position in which it engages with a plug housing. In one example, displacing the compliant portion 148 by 0.3 mm exerts a pressure of 800 MPa on the spring tab 144 and generates a contact force of 0.44 N.

Figure 7B:
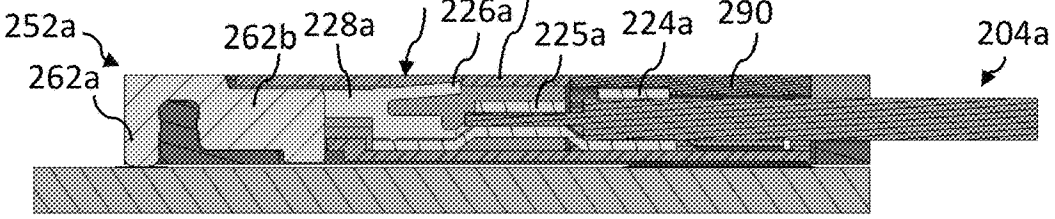
FIG. 7B is a side cross-sectional view of the electrical interconnect system 200 of FIG. 7A, in accordance with some embodiments.
Figure 7A:
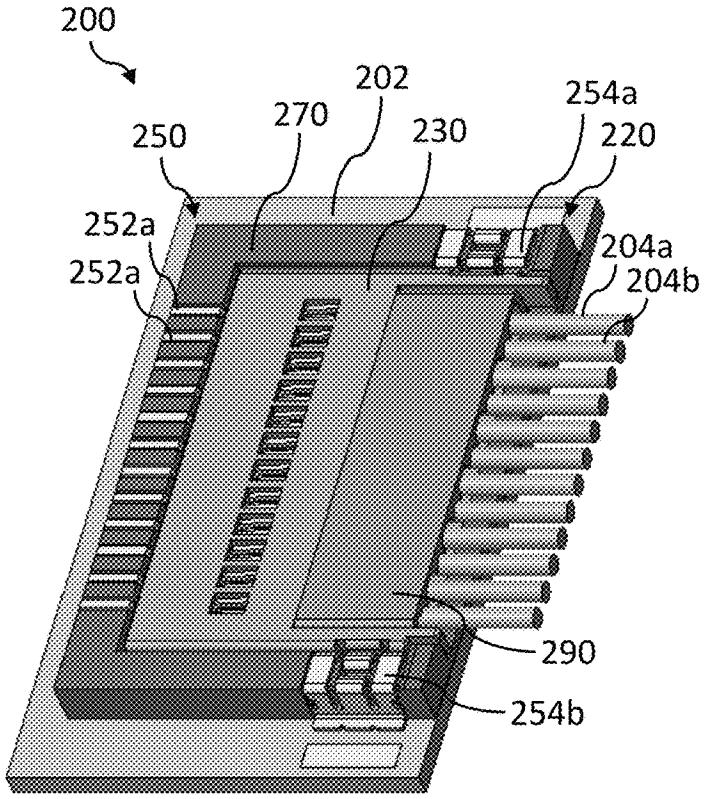
FIG. 7A is a top perspective view of an alternative electrical interconnect system 200 that includes a receptacle connector 220 and a plug connector 250, in accordance with some embodiments.

FIG. 7A is a top perspective view of an alternative electrical interconnect system 200 that includes a receptacle connector 220 and a plug connector 250, in accordance with some embodiments. FIG. 7B is a side cross-sectional view of the electrical interconnect system 200. Similar to the plug connector 140 of the electrical interconnect system 100, the plug connector 250 may be mounted to a board 202, such as by surface mount soldering, which may be a printed circuit board in some embodiments. In the embodiment of FIG. 7A, the receptacle connector 220 terminates twelve insulated wires, of which insulated wires 204*a* and 204*b* are labeled. In the mated configuration shown in FIG. 7A, the receptacle connector 220 and plug connector 250 may electrically connect conductors of the insulated wires to conductive pads (not shown) on the board 202. In some embodiments, the insulated wires shown in FIG. 7A may be configured in the manner described for the insulated wires 104*a* and 104*b* of FIGS. 1A-1B. In some embodiments, the electrical interconnect system 100 may have a small form factor, such as less than 1 mm in height.

Similar to the receptacle connector 120, the receptacle connector 220 includes a receptacle housing 230, which may be configured to support a receptacle terminal for each of the insulated wires, of which terminal 222*a* is shown in FIG. 2B. The receptacle housing 230 may be formed using an insulative material such as plastic. The receptacle terminals may be formed using a conductive material such as phosphor bronze. In one example, the receptacle terminals may be formed using phosphor bronze having a thickness between 0.75 mm and 0.2 mm, between 0.1 mm and 0.14 mm, such as 0.12 mm. In FIG. 7B, a conductor 206*a* of the insulated wire 204*a* may be mounted to the receptacle terminal 122*a*, with a crimped portion 224*a* of the receptacle terminal 222*a* holding the conductor 206*a*. The conductor 206*a* may be formed using copper in some embodiments. A terminal lance 226*a* of the receptacle terminal 122*a* may protrude into and, in the illustrated embodiment, through an opening in the receptacle housing 230 to prevent the receptacle terminal 222*a* from being removed from the receptacle housing 230 when the insulated wire 204*a* is pulled away from the receptacle housing 230. The terminal lance 226*a* may be shaped to slide along the top wall of the receptacle housing 230 when inserted into the receptacle housing 230. The receptacle terminal 222*a* is further illustrated in FIGS. 11A-11B and 12A-12B.

The receptacle connector 220 further includes a wire cover 290 disposed on the top side of the receptacle housing 230. In some embodiments, the wire cover 290 may be formed using an insulative material such as plastic. The wire cover 290 may include multiple wire slots configured to hold the insulated wires in place in the receptacle housing 230. The wire cover 290 is further illustrated in FIG. 10B. In some embodiments, the receptacle connector 220 may have a height of 1 mm or less.

Similar to the plug connector 140, the plug connector 250 includes a plug housing 270, which may be configured to support twelve plug terminals, of which the plug terminals 252*a* and 252*b* are labeled. In some embodiments, the plug connector 250 may have a height of 1 mm or less.

The plug housing 270 may be formed using an insulative material such as plastic. The plug terminals may be formed using a conductive material such as phosphor bronze, with or without plating to support surface mount soldering of the plug terminals to the board 202. As shown in FIG. 7B, the plug terminal 252*a* has at least one first portion 262*a* configured for surface mount soldering to a pad on the surface of the board 202 and a second portion 262*b* positioned to contact the receptacle terminal 222*a* when the receptacle connector 220 is inserted into the plug connector 250. The plug terminals of the plug connector 250 may have blade contacts. The bottom surface of the plug housing 270 may have openings to allow the plug terminals to be mounted (e.g., soldered) to conductive pads on the board 202, thereby securing the plug terminals to the board 202. In the embodiment illustrated, each of the plug terminals 252*a* and 252*b* has a portion outside plug housing 270 configured for soldering to board 202 and a portion in an interior of plug housing 270 also for soldering. Between the two portions, the plug terminals engage a wall of housing 270, securing the housing 270 to the board 202 when the ends of the terminal are soldered to the board 202. In some embodiments, securing the plug terminals 252*a* and 252*b* to the board 202 may mechanically secure the plug housing 270 to the board 202. As shown in FIG. 7B, the plug terminal 252*a* may be configured for electrically coupling to the receptacle terminal 222*a* to electrically connect one or more conductive pads on the surface of the board 202 and a conductor of the insulated wire 204*a*.

In the embodiment of FIGS. 7A and 7B, the receptacle connector 220 may be secured in the plug housing 270 by engaging the front of the receptacle connector 220 with a front wall of the plug housing 270 at an acute angle with respect to the surface of the board 202 and then rotating the rear of the receptacle housing 230 into a recess of the plug housing 270. The rear of the receptacle connector 220 may engage features on the plug housing 270, securing the receptacle connector 220 in the plug connector 250.

In the illustrated embodiment, the plug housing 270 supports locking tabs 254*a* and 254*b*. The locking tabs 254*a* and 254*b* may be formed using a compliant material. In some embodiments, the locking tabs 254*a* and 254*b* may be formed using an electrically conductive material such as phosphor bronze, with or without plating to support surface mounting of the locking tabs 254*a* and 254*b* to the surface of the board 202. In other embodiments, the locking tabs 254*a* and 254*b* may be formed using stainless steel or spring steel. The locking tabs 254*a* and 254*b* may each have multiple folded portions disposed over the sides of a wall of the plug housing 270. One or more of the folded portions may extend to the board 202 for mounting (e.g., soldering) to pad(s) on the surface of the board 202. In some embodiments, the locking tabs 254*a* and 254*b* may be soldered to the surface of the board 202 to mechanically couple the housing 270 to the board 202. In some embodiments, the locking tabs 254*a* and 254*b* may be configured to electrically couple a structure of the plug connector 250 or the receptacle connector 220 to conductive pads on the surface of the board 202.

Figure 11A:
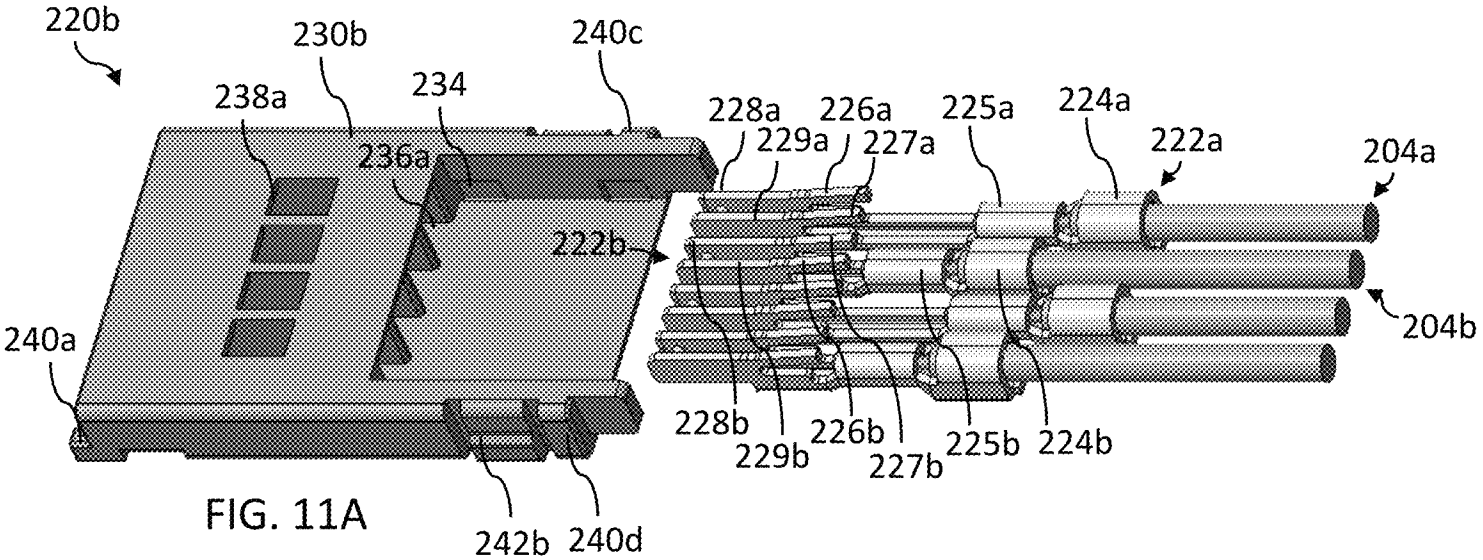
FIG. 11A is an exploded view of the receptacle connector 220*b* of FIG. 8B with the wire cover 290 removed, in accordance with some embodiments.
Figure 11B:
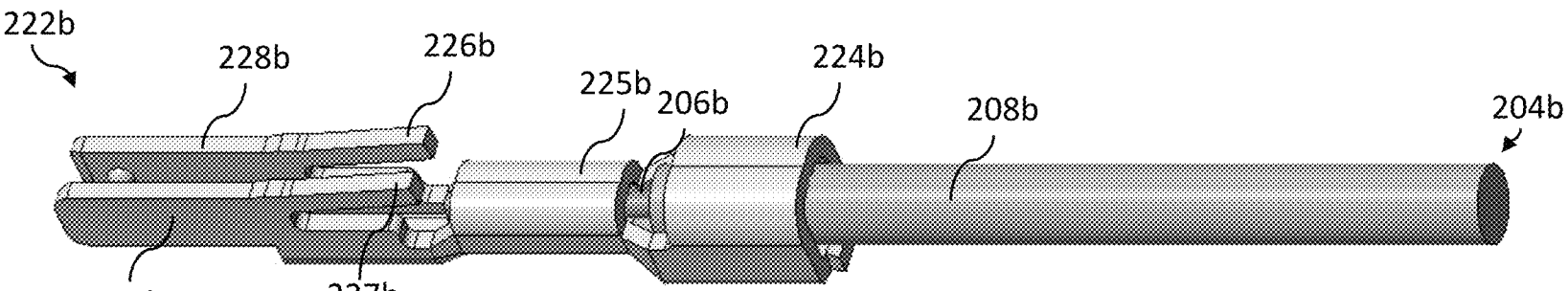
FIG. 11B is a perspective view of a receptacle terminal 222*b* and insulated wire 204*b* of the receptacle connector 220*b* of FIG. 8B, in accordance with some embodiments.

In some embodiments, the insulated wires may have at least one electrical conductor 206 which may be surrounded by an insulator 208 (shown in FIGS. 11A-11B, for example). The electrical conductor(s) 106 may include a pair of copper wires wrapped in plastic 108. Designs as described herein may be used in connection with small diameter wires. The conductors may have a diameter less than 32 AWG, in some embodiments. In other embodiments, the diameter may be smaller than 34 AWG, such as 36 AWG or 40 AWG or smaller.

Figure 8B:
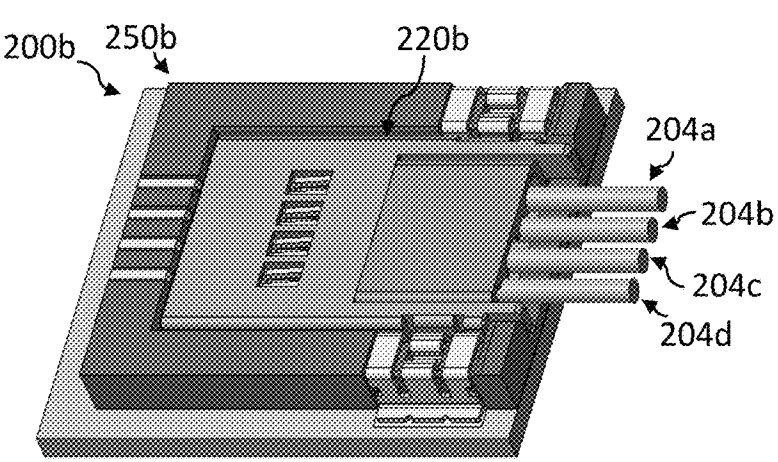
FIG. 8B is a top perspective view of an electrical interconnect system 200*b* configured to connect four wires to a board, in accordance with some embodiments.
Figure 8A:
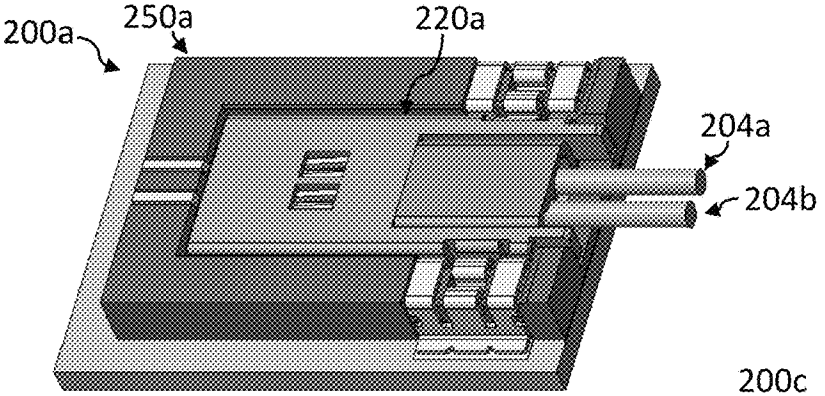
FIG. 8A is a top perspective view of an electrical interconnect system 200*a* configured to connect two wires to a board, in accordance with some embodiments.
Figure 8C:
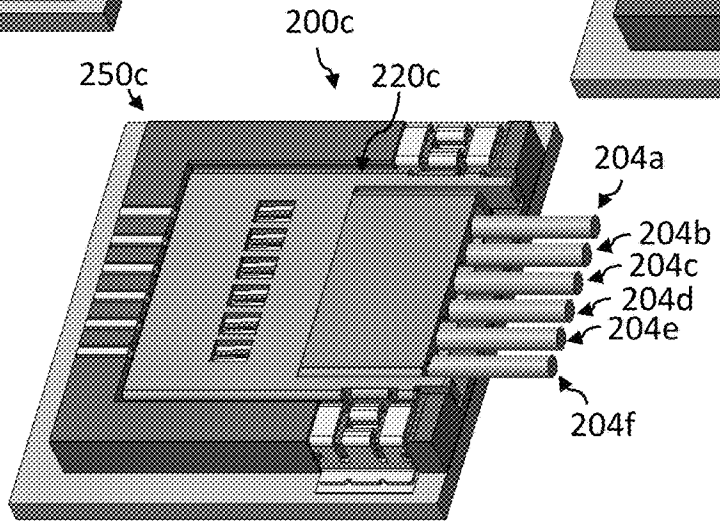
FIG. 8C is a top perspective view of an electrical interconnect system 200*c* configured to connect six wires to a board, in accordance with some embodiments.

Electrical interconnect systems described herein may be configured to support any number of cables and/or wires. For example, FIGS. 8A-8C show exemplary embodiments of electrical interconnect systems 200*a*-200*c* configured to support different numbers of cables and/or wires using structures to secure the receptacle connector in the plug connector as described above in connection with FIGS. 7A and 7B. FIG. 8A is a top perspective view of an electrical interconnect system 200*a* configured to connect two wires to a board. FIG. 8B is a top perspective view of an electrical interconnect system 200*b* configured to connect four wires to a board. FIG. 8C is a top perspective view of an electrical interconnect system 200*c* configured to connect six wires to a board.

Figures 9A, 9B, 9C, 9D, 9E, 9F, 9G:
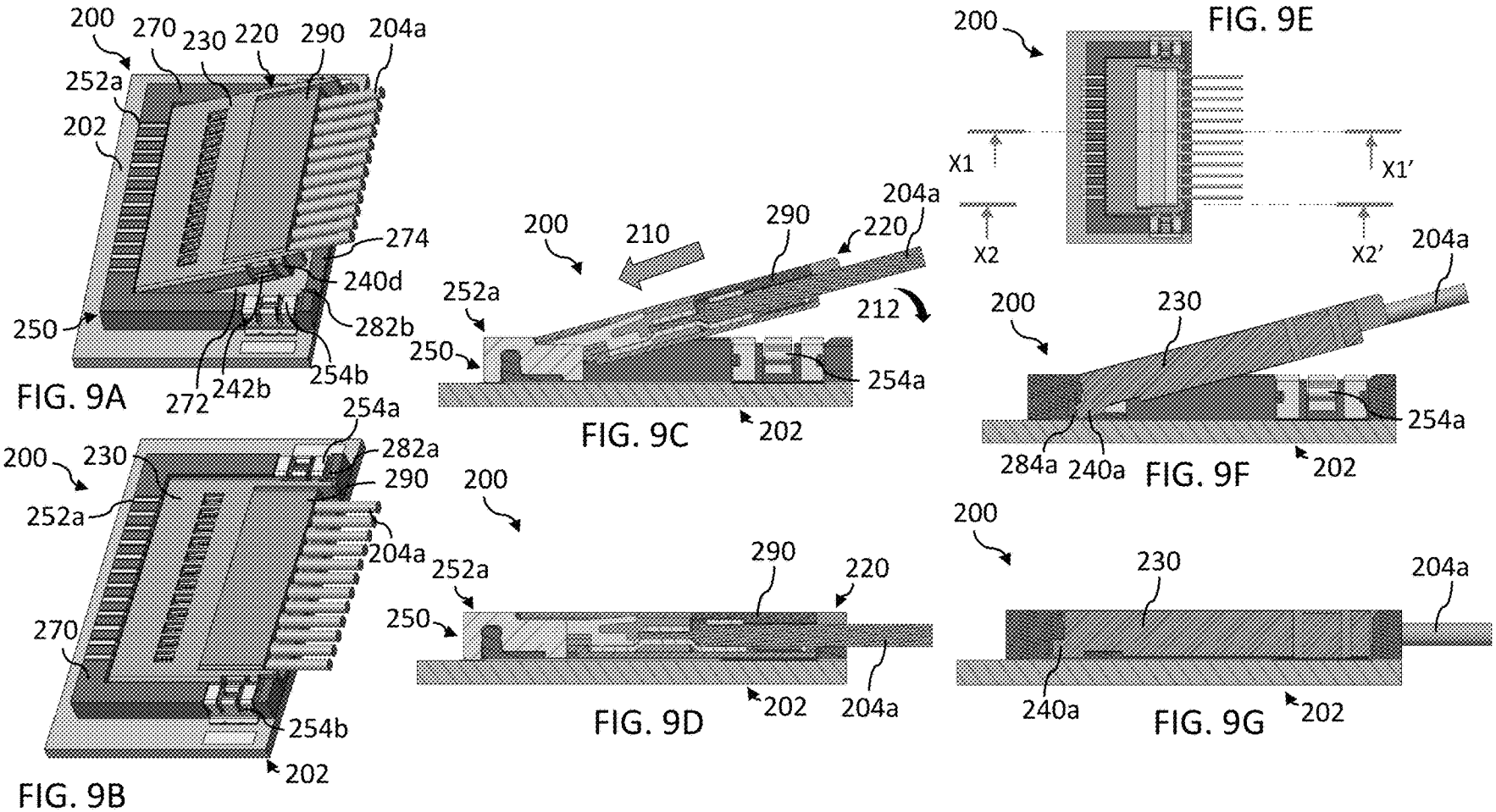
FIG. 9A is a top perspective view of the electrical interconnect system 200 of FIGS. 7A-7B in which the receptacle connector 220 is partially inserted into the plug connector 250, in accordance with some embodiments.
FIG. 9B is a top perspective view of the electrical interconnect system 200 of FIGS. 7A-7B in which receptacle connector 220 is in a secured position in the plug connector 250, in accordance with some embodiments.
FIG. 9C is a side view of a cross-section $X_1$-$X_1$' of the electrical interconnect system 200 of FIGS. 7A-7B in which the receptacle connector 220 is partially inserted into the plug connector 250, in accordance with some embodiments.
FIG. 9D is a side view of the cross-section $X_1$-$X_1$' of electrical interconnect system 200 of FIGS. 7A-7B in which receptacle connector 220 is in the secured position, in accordance with some embodiments.
FIG. 9E is a top view of the electrical interconnect system 200 of FIGS. 7A-7B, in accordance with some embodiments.
FIG. 9F is a side view of an alternative cross-section $X_2$-$X_2$' of the electrical interconnect system 200 of FIGS. 7A-7B in which the receptacle connector 220 is partially inserted into the plug connector 250, in accordance with some embodiments.
FIG. 9G is a side view of the alternate cross-section $X_2$-$X_2$' of the electrical interconnect system 200 of FIGS. 7A-7B in which receptacle connector 220 is in the secured position, in accordance with some embodiments.

FIGS. 9A-9G illustrate a method of mating the receptacle connector 220 and the plug connector 250, with structures as described above in connection with FIGS. 7A and 7B. FIGS. 9A-9B are top perspective views of the electrical interconnect system 200 as the receptacle connector 220 is inserted into and secured in the plug connector 250. FIGS. 9C-9D are side views of a cross-section of the electrical interconnect system 200 as the receptacle connector 220 is inserted into and secured in the plug connector 250. FIGS. 9F-9G are side views of an alternative cross-section of the electrical interconnect system 200 as the receptacle connector 220 is inserted into and secured in the plug connector 250. FIG. 9E is a top view of the electrical interconnect system 200 indicating the cross sections $X_1$-$X_1$' of FIGS. 9C-9D and $X_2$-$X_2$' of FIGS. 9F-9G.

As shown in FIGS. 9A, 9C, and 9F, a forward end of the receptacle connector 220 may be inserted along an insertion direction 210 into the plug connector 140. The insertion direction 210 may be similar to the insertion direction 110 described in connection with the electrical interconnect system 100. For example, the insertion direction 210 may make an acute angle with respect to the board 202, such as results from a forward end of the receptacle connector 220 being inserted into the plug connector 250 with the receptacle connector 220 oriented with a greater distance between the insulated wires and the board 202 than between the forward end of the receptacle connector 220 and the board 202. Insertion at an angle enables one or more projections from the receptacle connector 220 to extend under features of the plug housing 270, partially securing the receptacle connector 220 in the plug connector 250.

The plug terminals are shown in FIG. 9A (with plug terminal 252*a* labeled) separated from each other in a direction perpendicular to the insertion direction 210. As shown in FIGS. 9A and 9C, the plug housing 270 includes a recess 272 that may be shaped to accommodate the receptacle housing 230.

The receptacle housing 220 further includes one or more front projecting portions, such as front projections 240*a-b*, of which front projecting portion 240*a* is labeled in FIG. 9F. The receptacle housing 220 further includes features that engage complimentary features on the plug connector when the rear of the receptacle connector is pressed into the plug housing. In this example those features are located on sides of the receptacle connector near the rear. This features may be rear side projecting portions 240*c-d*, of which rear side projecting portion 240*d* is labeled in FIG. 9A.

The plug housing 270 further includes front receiving portions 284*a-b*, of which the front receiving portion 284*a* is labeled in FIG. 9F. and rear side projecting portions 282*a-b*, of which the rear side projecting portion 282*b* is labeled in FIG. 9A. The front receiving portions 284*a-b* of the plug housing 270 may be shaped to accommodate the front projecting portions 240*a-b* of the receptacle housing 230, respectively. The rear side projecting portions 282*a-b* of the plug housing 270 may be positioned to engage the rear housing projections 240*c-d* of the receptacle housing 230, respectively, and may form or be a portion be a portion of a rear wall of the plug housing. The rear side projecting portions 282*a-b* of the plug housing 270 and the rear side projecting portions 240*c-d* may be disposed on opposite sides of the slot 276 at the rear ends of the plug connector 250 and the receptacle connector 220, respectively.

As shown in FIG. 9F, the front projecting portion 240*a* of the receptacle housing 230 and the front receiving portion 284*a* of the plug housing 270 are disposed on front ends of the plug connector 250 and the receptacle connector 220, respectively. As the receptacle connector 220 is inserted into the recess 272 of the plug connector 250, the front projecting portion 240*a* may enter the front receiving portion 284*a*, as shown in FIGS. 9F-9G.

Once the receptacle connector 220 has been inserted into the recess 272 of the plug connector 250, the rear of the receptacle connector 220 may be rotated in direction 212 toward the board 202. The axis of rotation for receptacle connector 220 may be established by engagement of the front of the receptacle connector 220 with the front wall of the plug housing 270 and may be perpendicular to the insertion direction 210. FIGS. 9B, 9D, and 9G show the receptacle connector 220 secured in the plug connector 250 after the receptacle connector 220 has been rotated in direction 212.

The plug housing 170 may have and a slot 276 in the rear wall of the plug housing 270 that may be shaped to accommodate the insulated wires when the receptacle connector 220 is lowered into the plug connector 250. The insulated wires may be elongated and extend through the slot 276.

As shown in FIGS. 9A-9B, the receptacle connector 220 may be secured in the plug connector 250 by engagement of features on the receptacle connector 220 and on the plug connector 250. In this example, the plug connector 250 has at least one locking tab that is positioned to engage a surface on the receptacle connector 220 when the rear of the receptacle connector 220 is rotated into the plug connector 250. For example, the locking tabs 254*a-b* shown in FIGS. 9A-9B may engage locking ledges 242*a-b* of the receptacle housing 230, of which the locking ledge 242*b* is shown in FIG. 9A, to prevent the receptacle connector 220 from being rotated at least partially about the axis 212 out of the recess 272 of the plug connector 250. The locking ledges 242*a-b* of the receptacle housing 230 may latch onto compliant portions 258*a-b* of the locking tabs 254*a-b* to secure the receptacle connector 220 in the recess 272 of the plug connector 250. The rear side projecting portions 282*a-b* of the plug housing 270 may be configured to prevent the receptacle connector 220 from sliding out of the rear end of the recess 272 when the insulated wires are pulled in a rearward direction. The front projecting portions 240*a-b* of the receptacle housing 230 and the front receiving portions 284*a-b* of the plug housing 270 may be configured to impede movement of the receptacle connector 220 in an upward direction away from the board 202.

Figure 10B:
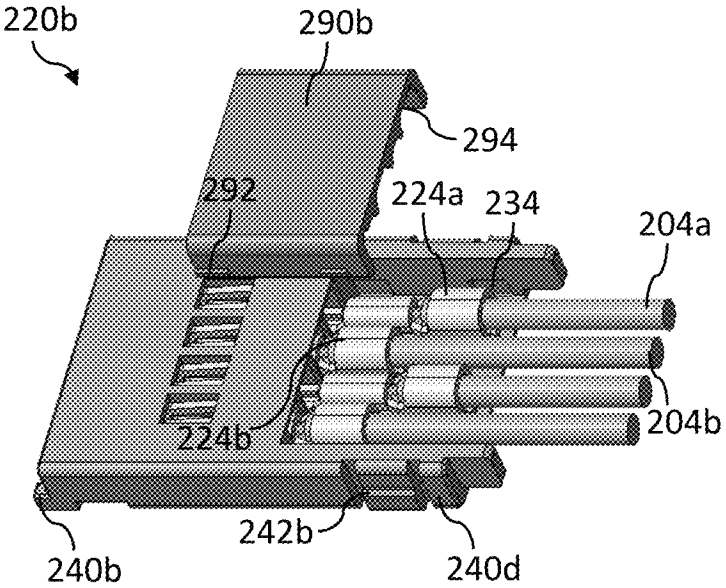
FIG. 10B is partially-exploded view of the receptacle connector 220*b* of FIG. 8B in which the wire cover 290 is removed from the receptacle housing 230, in accordance with some embodiments.
Figure 10A:
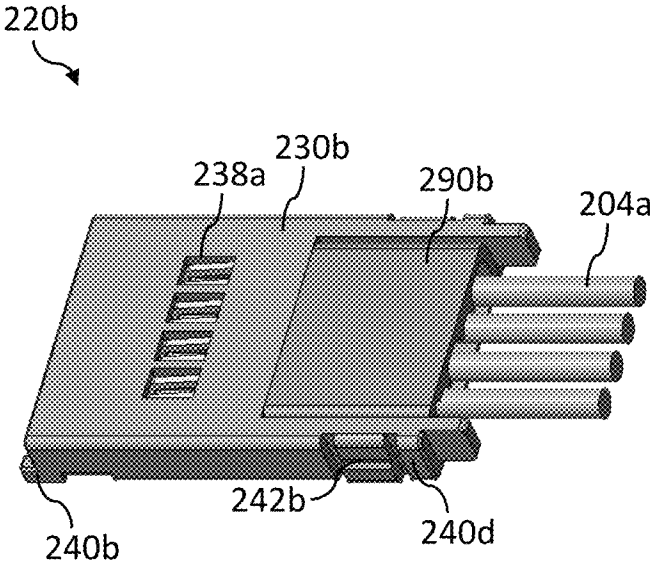
FIG. 10A is a top perspective view of the receptacle connector 220*b* of FIG. 8B, in accordance with some embodiments.

FIGS. 10A-10E further illustrate the receptacle connector 220*b* of FIGS. 8B and 9A-9G. FIG. 10A is a top perspective view of the receptacle connector 220*b*. As shown in FIG. 10A, the receptacle housing 230*b* further includes terminal lance slots, of which terminal lance slot 238*a* is labeled, which may be configured to engage terminal lances of the receptacle contacts, as described herein. Also shown in FIG. 10A is the locking ledge 242*b*, which may be configured to engage a locking tab of the plug connector 250*b* when the receptacle connector 220*b* is inserted into the plug connector 250*b*. Such a ledge may be formed by forming a recess into a plane of the side wall of the receptacle housing 230 above the ledge or by a projection from the plane of the side wall below the ledge. In the illustrated embodiment, the ledge is formed by a recess into the wall above the ledge. A bottom side of the locking ledge 242*b* has a rounded edge that may glide over the locking tab when the receptacle connector 220*b* is inserted into the plug connector 250*b*, and the top side of the locking ledge 242*b* is substantially flat to prevent the top side from inadvertently gliding over the locking tab when the receptacle connector 220*b* is secured in the plug connector 250*b* and an upward force is exerted on the receptacle connector 220*b*.

FIG. 10B is partially-exploded view of the receptacle connector 220*b* in which the wire cover 290*b* is removed from the receptacle housing 230*b*. As shown in FIG. 10B, the wire cover 290*b* includes projections 292 and wire slots 294. The projections 292 may be configured to enter wire cover slots 234 on the side walls of the receptacle housing 230*b* to secure the wire cover 290*b* to the receptacle housing 230*b*. The wire slots 294 may be shaped to accommodate the insulated wires. With the wire cover 290*b* removed, the crimped portions (e.g., 224*a*) of the receptacle terminals are shown holding the insulated wires.

Figure 10D:
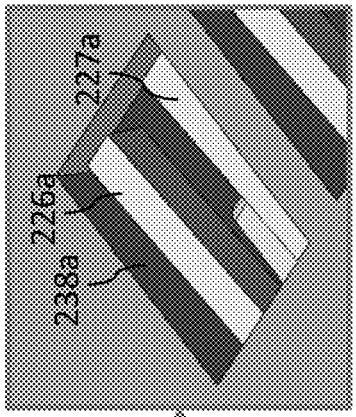
FIG. 10D is an enlarged view of the terminal lance slot 238*a* of the receptacle housing 230 shown in FIG. 10C, in accordance with some embodiments.
Figure 10C:
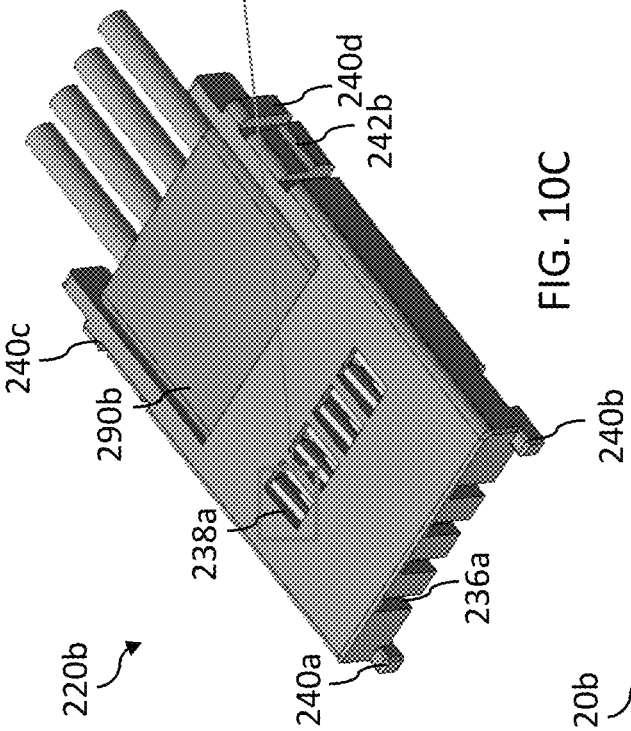
FIG. 10C is a top perspective view of the receptacle connector 220*b* of FIG. 8B, in accordance with some embodiments.

FIG. 10C is a top perspective view of the receptacle connector 220*b*. FIG. 10C shows the front projecting portions 240*a-b* and the rear side projecting portions 240*c-d* of the receptacle housing 230*b*. FIG. 10C also shows terminal slots in the front wall of the receptacle housing 230*b*, of which the terminal slot 236*a* is labeled. The terminal slots may be shaped to accommodate the plug terminals of the plug connector 250*b* when the receptacle connector 220*b* is inserted into the plug connector 250*b* such that the receptacle terminals can electrically couple to the plug terminals. FIG. 10C also shows the terminal lance slots. FIG. 10D is an enlarged view of a portion of the receptacle connector 220*b* illustrating engagement of a terminal 222*a* with the receptacle housing 230*b*. In FIG. 10D, the terminal lances 226*a* and 227*a* of the receptacle terminal 222*a* extend into the terminal lance slot 238*a* on the top surface of the receptacle housing 230*b*, blocking withdrawal of the terminal 222*a* from the receptacle housing 230*b*.

Figure 10E:
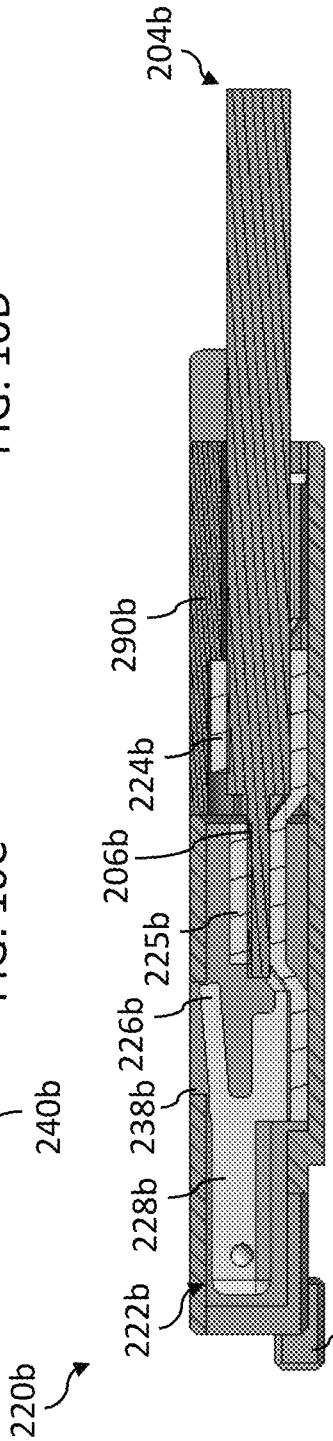
FIG. 10E is a side view of a cross-section of the receptacle connector 220*b* of FIG. 8B through the insulated wire 204*b* and the receptacle terminal 222*b*, in accordance with some embodiments.

FIG. 10E is a side view of a cross-section of the receptacle connector 220*b* through the insulated wire 204*b* and the receptacle terminal 222*b*. The cross-section shown in FIG. 10E includes one side of the receptacle terminal 222*b*, including part of the crimped portions 224*b* and 225*b*, one of the terminal lances 226*b*, and one of the contact portions 228*b*. As shown in FIG. 10E, the insulated wires may include a conductor (e.g., 206*b* of insulated wire 204*b*).

FIGS. 11A-11B and 12A-12B further illustrate the receptacle terminals of the receptacle connector 220*b* of FIG. 8B. FIG. 11A is an exploded view of the receptacle connector 220*b* of FIG. 8B with the wire cover 290 removed, in accordance with some embodiments. FIG. 11B is a perspective view of the receptacle terminal 222*a* and the insulated wire 204 of the receptacle connector 220. The receptacle terminal 222*b* includes terminal lances 226*b* and 227*b* and contact portions 228*b* and 229*b*. The terminal lances 226*b* and 227*b* may be configured to engage the terminal lance slots of the receptacle housing 230. The terminal lances 226*b* and 227*b* may be cut from the contact portions 228*b* and 229*b*. The terminal lances 226*b* and 227*b* may be biased away from the top side such that they will spring outwards and engage a feature of the receptacle housing 230*b* to secure the receptacle terminal 222*b* to the receptacle housing 230*b*.

As shown in FIGS. 11A-11B, the insulated wire 204*b* includes a conductor 206*b* and an insulator 208*b*. Also shown in FIGS. 11A-11B, crimped portions 224*b* may be configured to hold the insulator 208*b*, and crimped portions 225*b* may be configured to hold the conductor 206*b*. The crimped portions 225*b* may electrically couple to the conductor 206*b*. The crimped portions 225*b* around the conductor 206*b* make an electrical connection between the receptacle terminal 222*b* and the conductor 206*b*.

As shown in FIG. 11A, the crimped portions 224*a* and 224*b* of adjacent receptacle terminals 222*a* and 222*b* may be offset from one another in the direction in which the receptacle terminals 222*a* and 222*b* are elongated. The crimped portions 225*a* of the receptacle terminal 222*a* may be positioned adjacent the crimped portions 224*b* of the receptacle terminal 222*b*. The crimped portions 224*a* may be wider than the crimped portions 225*b*, such that the offset between the crimped portions 224*a* and 224*b* and the positioning of the crimped portions 224*a* adjacent the crimped portions 225*b* may reduce a combined width of the receptacle terminals, thereby reducing a width of the receptacle connector 220*b*. The wire slots 294 of the wire cover 290*b* may be shaped to accommodate the offset-positioned crimped portions 224*a* and 224*b* of the receptacle terminals 222*a* and 222*b*.

The contact portions 228*b* and 229*b* may be configured to electrically couple to a plug terminal of the plug connector 250*b* when the receptacle connector 220*b* is inserted into the plug connector 250*b*. In some embodiments, the contact portions 228*b* and 229*b* may be compliant such that they exert a contact force on the plug contacts of the plug connector 250*b* when the plug connector and the receptacle connectors are mated. The contact portions 228*a* and 229*a* may include protrusions to increase the contact pressure at the mating interface. In one example, displacing the contact portions 228*b* and 229*b* by 0.06 mm exerts a pressure of 1,000 MPa on the contact portions 228*b* and 229*b* an and a slot 276 in the rear wall of the plug housing 270 that may be shaped to accommodate the insulated wires when the receptacle connector 220 is lowered into the plug connector 250. The insulated wires may be elongated and extend through the slot 276.*d* generates a contact force of 0.59 N.

Figure 12A:
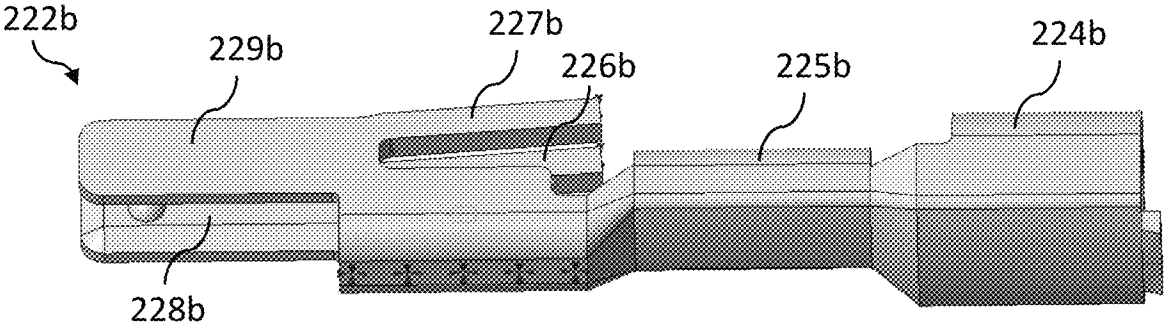
FIG. 12A is a side view of the receptacle terminal 222*b* shown in FIG. 11B, in accordance with some embodiments.
Figure 12B:
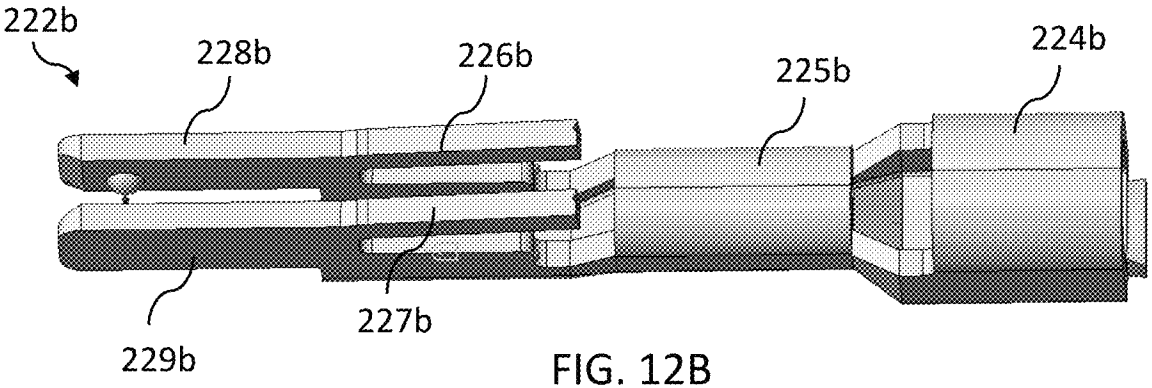
FIG. 12B is a top view of the receptacle terminal 222*b* shown in FIG. 11B, in accordance with some embodiments.

FIG. 12A is a side view of the receptacle terminal 222*b*. FIG. 12B is a top view of the receptacle terminal 222*b* shown in FIG. 11B.

Figure 13B:
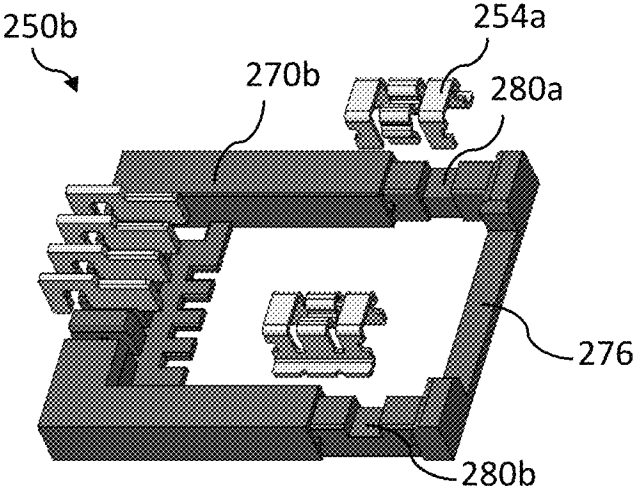
FIG. 13B is an exploded view of the plug connector 250*b* of FIG. 8B, in accordance with some embodiments.
Figure 13A:
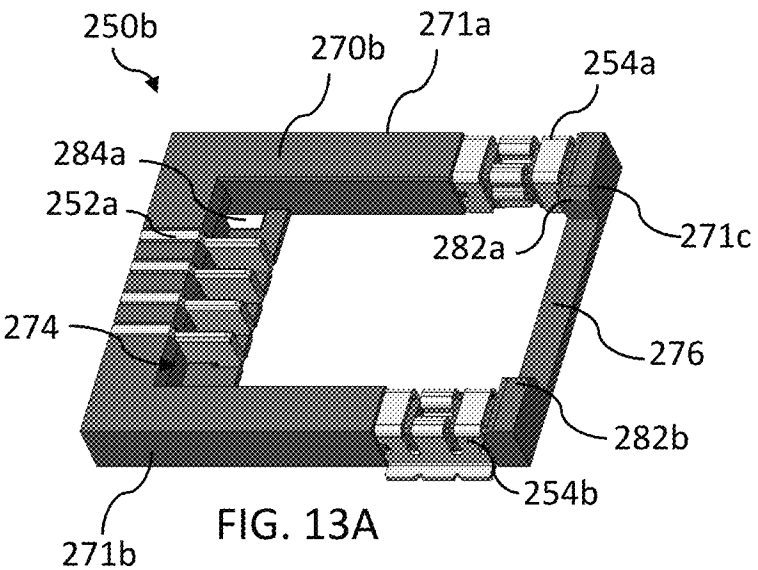
FIG. 13A is a top perspective view of the plug connector 250*b* of FIG. 8B, in accordance with some embodiments.
Figure 13C:
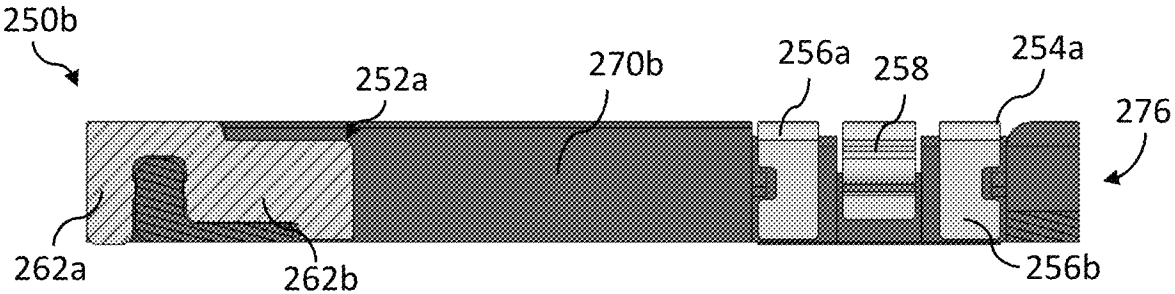
FIG. 13C is a side view of a cross-section of the plug connector 250*b* of FIG. 8B, in accordance with some embodiments.

FIGS. 13A-13C further illustrate the plug connector 250*b* of FIG. 8B. FIG. 13A is a top perspective view of the plug connector 250*b*. FIG. 13A shows the front receiving portion 284*a*, the rear side projecting portions 282*a-b*, and the receiving slot 276 in the rear wall 271*c* of the plug housing 270*b*, and the locking tabs 254*a-b* disposed over the side walls of the plug housing 270*b*. FIG. 13B is an exploded view of the plug connector 250*b* of FIGS. 7A-7B. In FIG. 13B, the plug terminals and the locking tabs 254*a-b* are removed from the plug housing 270*b* to show the terminal slots 274 and the locking tab slots 280*a-b* of the plug housing 270*b*, which may be configured to hold the plug terminals and the locking tabs 254*a-b*.

FIG. 13C is a side view of a cross-section of the plug connector 250*b* through the plug terminal 252*b*. As shown in FIG. 13C, the locking tab 254*a* includes coupling portions 256*a-b* and a compliant portion 258. The coupling portions 256*a-b* may fold over a side of a side wall 271*a* of the plug housing 270*b* and attach to protrusions from the side wall 271*a* of plug housing 270*b* that extend into slots in coupling portions 256*a-b*. The coupling portions 256*a-b* may each form U shape, fitting over two sides of the side wall 217*a*.

The compliant portion 258 may align with a recess 272 of the plug housing 270*b*, such that the compliant portion 258 may be pressed into side walls (e.g., 271*b*) of the plug housing 270*b* to provide clearance for the receptacle connector 220*b* when inserted into the plug connector 250*b*. When the receptacle connector 220*b* is inserted, compliant portion 258 may spring back, engaging a ledge 242*a* or 242*b* on the receptacle connector 220*b*.

In the illustrated embodiment, the compliant portion 258 is "M" shaped. The M shape may provide a suitable flexibility/rigidity to the compliant portion 258 to enable easy insertion of the receptacle connector 220*b* into the plug housing 270*b* while sufficient retention force to prevent inadvertent release of the receptacle connector 220*b* from the plug housing 270*b* over a range of operating conditions.

Figure 14:
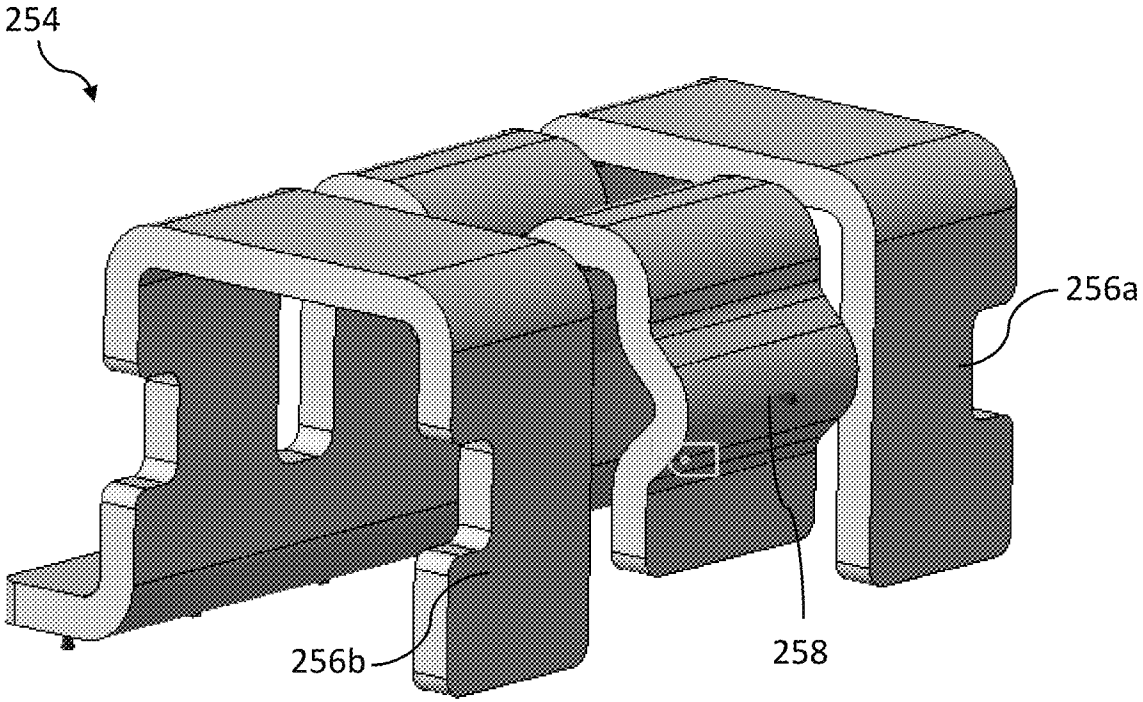
FIG. 14 is a perspective view of a locking tab 254 that may be included in the plug connector 250*b* of FIG. 8B, in accordance with some embodiments.

FIG. 14 is a perspective view of a locking tab 254, which may be either of the locking tabs 254*a-b* of the plug connector 250*b*, in accordance with some embodiments. As shown in FIG. 14, the locking tab 254 includes coupling portions 256*a* and 256*b* and the compliant portion 258. The locking tab 254 further includes a mounting portion 260 that may be mounted (e.g., soldered) to a pad of the board 202. When the compliant portion 258 engages a locking projection of the receptacle housing 230*b*, the coupling portions 256*a* and 256*b* may hold the receptacle housing 230*b* to the plug housing 270*b*, and the mounting portion 260 may hold the receptacle housing 230 and the plug housing 270*b* to the board 202. In one example, displacing the compliant portion 258 by 0.08 mm may exert a pressure of 900 MPa and generate a contact force of 2.7 N.

Having thus described several aspects of at least one embodiment of this invention, it is to be appreciated that various alterations, modifications, and improvements will readily occur to those skilled in the art.

For example, in the illustrated embodiments, two wires are terminated in a receptacle connector. A person of skill in the art will appreciate that variations of such a connector may be made. The cables, for example, may be terminated by a plug connector. A connector with receptacle terminals may be mounted to a board. Likewise, more or fewer wires may be terminated by a connector.

As another example, a connector was described as terminating insulated wires 104*a* and 104*b* with a single conductor each. In other embodiments, the wires may have other configurations, such as coaxial or twin-axial cables. In some embodiments, the insulated wires 104*a* and 104*b* or electrical cables may include another conductor (e.g., a ground and/or shielding conductor) surrounding the wires or cables.

As a further example, a wire cover is shown as a separate piece with features that engage the receptacle housing to hold the cover in place. A cover alternatively or additionally may be formed by insert molding material around the wires.

Such alterations, modifications, and improvements are intended to be part of this disclosure, and are intended to be within the spirit and scope of the invention. Further, though advantages of the present invention are indicated, it should be appreciated that not every embodiment of the invention will include every described advantage. Some embodiments may not implement any features described as advantageous herein and in some instances. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

"Consisting essentially of," when used in the claims, shall have its ordinary meaning as used in the field of patent law.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. An electrical connector, comprising:

an insulative housing comprising an opening for receiving a second connector, wherein the opening is bounded by at least a first wall and a second wall of the insulative housing, and the first wall comprises at least one receiving portion configured to receive a projection from the second connector, and the second wall is transverse to the first wall;

a plurality of conductive terminals attached to the first wall of the insulative housing and extending into the opening; and at least one locking tab folded about an axis that is parallel to a direction of elongation of the second wall of the insulative housing such that the at least one locking tab extends over an upper surface of the second wall of the insulative housing, wherein:

the at least one locking tab comprises a compliant portion configured to engage a surface on the second connector when the second connector is inserted in the opening.

2. The electrical connector of claim 1, wherein:

the at least one receiving portion is configured to receive the projection from the second connector when the second connector is inserted in a first direction;

the opening of the insulative housing comprises a bottom surface; and the electrical connector is configured such that the first direction is at an acute angle with respect to the bottom surface.

3. The electrical connector of claim 2, wherein the at least one receiving portion of the first wall comprises a slot configured to receive the projection of the second connector.

4. The electrical connector of claim 2, wherein the insulative housing further comprises a rear wall disposed on an opposite side of the insulative housing from the first wall, and the rear wall comprises a slot configured to accommodate wires and/or cables extending from the second connector when the second connector is inserted into the opening.

5. The electrical connector of claim 1, wherein the plurality of conductive terminals each comprise:

a first portion configured for mounting to a surface of a printed circuit board; and a second portion configured for mounting to the surface of the printed circuit board, with the first wall of the insulative housing secured between the first and second portions.

6. The electrical connector of claim 1, wherein the at least one locking tab comprises a U-shaped coupling portion fitted over the second wall.

7. The electrical connector of claim 6, wherein the at least one locking tab further comprises a compliant portion.

8. The electrical connector of claim 7, wherein the at least one locking tab comprises:

a first locking tab disposed around first and second opposite sides of a first side wall of the at least one side wall; and a second locking tab disposed around first and second opposite sides of a second side wall of the at least one side wall, wherein the first and second side walls are disposed on opposite sides of the opening.

9. The electrical connector of claim 7, wherein the at least one locking tab further comprises at least one mounting portion extending from the coupling portion and configured for mounting to a surface of a substrate.

10. The electrical connector of claim 1, wherein the plurality of conductive terminals comprise blade contacts.

11. The electrical connector of claim 1, wherein the electrical connector has a stacking height of 1 millimeter (mm) or less.

12. An electrical connector, comprising:

an insulative housing;

a plurality of conductive terminals supported by a first wall of the insulative housing; and at least one spring supported by a second wall of the insulative housing, wherein:

the insulative housing comprises an opening for receiving a second connector, wherein the first connector comprises a first receiving portion for retaining the second connector at a first end of the opening and a second receiving portion for retaining the second connector at a second end of the opening, wherein the first end is offset from the second end in a first direction, and the at least one spring is configured to apply a force to the second connector in the first direction when the second connector is in the opening.

13. The electrical connector of claim 12, further comprising a member comprising a coupling portion attached to the insulative housing, a bent portion and an elongated portion connecting the bent portion to the coupling portion, wherein the at least one spring comprises the bent portion of the member.

14. The electrical connector of claim 13, wherein the second wall is a side wall comprising a second opening, wherein the elongated portion is disposed outside of the second opening and the bent portion extends through the second opening.

15. The electrical connector of claim 14, wherein the second opening is elongated in the first direction to accommodate movement of a corner of the bent portion the first direction when the bent portion is compressed.

16. The electrical connector of claim 12, wherein the insulative housing further comprises a first projecting portion positioned above the first receiving portion and a second projecting portion positioned above the second receiving portion, each of the first and second projecting portions configured to interlock with a respective projecting portion of an insulative housing of the second connector.

17. The electrical connector of claim 16, wherein:

the plurality of conductive terminals are positioned in a line extending in a second direction perpendicular to the first direction; and the first and second projecting portions are configured to impede movement of the second connector in a third direction perpendicular to the first and second directions.

18. The electrical connector of claim 12, wherein:

the at least one spring comprises a surface positioned to contact the second connector upon insertion of the second connector into the opening; and the plurality of conductive terminals and the surface of the at least one spring are separated in the second direction.

19. The electrical connector of claim 12, wherein the at least one spring comprises first and second springs attached to first and second opposite sides of the insulative housing, wherein the first and second sides extend parallel to the first direction.

20. The electrical connector of claim 19, wherein the plurality of conductive terminals are attached to a third side of the insulative housing different from the first and second opposite sides.

21. The electrical connector of claim 12, wherein:

the plurality of conductive terminals are positioned at a first end of the insulative housing adjacent the first end of the opening;

the insulative housing comprises a slot at a second end opposite the first end; and the slot is configured to accommodate a plurality of electrical conductors coupled to the second connector upon insertion of the second connector into the recessed area.

22. The electrical connector of claim 21, wherein the plurality of electrical conductors comprise at least one electrical cable and/or a plurality of wires.

23. An electrical connector system, comprising:

the electrical connector of claim 12, the second connector, wherein the second connector comprises:

a second plurality of conductive terminals configured to receive the first plurality of conductive terminals;

a second housing supporting the first plurality of conductive terminals; and a plurality of electrical conductors terminating at the second connector and electrically coupled to the second plurality of conductive terminals.

24. A method of mating a cable connector with a board connector, the method comprising:

inserting the cable connector into a recess of the board connector along a first direction;

securing the cable connector to the board connector at least in part by:

applying a spring force to the cable connector in a second direction at least partially opposite the first direction; and impeding movement of the cable connector in direction perpendicular to the second direction, wherein blade contacts of the board connector are inserted into receptacle terminals of the cable connector when the cable connector is inserted into and secured to the board connector.

25. The method of claim 24, wherein applying the spring force comprises physically contacting the cable connector with at least one spring of the board connector.

26. The method of claim 24, wherein inserting the cable connector into the recess of the board connector comprises accommodating electrical conductors coupled to the cable connector in a slot of the board connector.

27. The method of claim 26, wherein accommodating the electrical conductors comprises accommodating at least one electrical cable or wire in the slot.

28. The electrical connector of claim 5, wherein the second portion extends into the opening and is adjacent a surface of the insulative housing such that the second portion is configured to be mounted to the surface of the printed circuit board.

* * * * *